US006860247B2

(12) United States Patent
Asai et al.

(10) Patent No.: US 6,860,247 B2
(45) Date of Patent: Mar. 1, 2005

(54) ENGINE VARIABLE VALVE TIMING SYSTEM

(75) Inventors: Akira Asai, Hiroshima (JP); Masaki Fukuma, Hiroshima (JP); Masahiro Naito, Hiroshima (JP); Kouichi Shimizu, Hiroshima (JP); Ikuma Takahashi, Hiroshima (JP); Kazuhiro Tomizawa, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 10/714,227

(22) Filed: Nov. 14, 2003

(65) Prior Publication Data

US 2004/0094106 A1 May 20, 2004

(30) Foreign Application Priority Data

Nov. 14, 2002 (JP) ..... 2002-330648
Feb. 6, 2003 (JP) ..... 2003-029290

(51) Int. Cl.[7] ..... F01L 1/34
(52) U.S. Cl. ..... 123/90.17; 123/90.15
(58) Field of Search ..... 123/90.15, 90.17, 123/90.31

(56) References Cited

U.S. PATENT DOCUMENTS 6,076,492 A 6/2000 Takahashi
6,289,861 B1 9/2001 Suzuki
6,405,694 B2 6/2002 Sato
6,478,000 B2 * 11/2002 Ishii et al. ..... 123/90.17
6,516,759 B2 * 2/2003 Takahashi et al. ..... 123/90.15
2002/0043230 A1 4/2002 Kinugawa

FOREIGN PATENT DOCUMENTS

EP 0 945 598 A2 3/1999
EP 1 046 793 A2 3/2000
EP 1 057 982 A2 5/2000
JP 2001-050102 2/2001

OTHER PUBLICATIONS

European Search Report Communication dated Mar. 3, 2004.

* cited by examiner

*Primary Examiner*—Thomas Denion
*Assistant Examiner*—Zelalem Eshete
(74) *Attorney, Agent, or Firm*—Brooks Kushman P.C.

(57) ABSTRACT

In the variable valve timing system according to the present invention, portions of the intake-side advancing hydraulic line and a retarding hydraulic line respectively constitute annular grooves 104 and 113 for advancing and retarding provided on the intake camshaft 5 bearing surface 5*a* of the cam cap 4 which supports the camshafts 5 and 6. In addition, portions of the advancing hydraulic line and the retarding hydraulic line for exhaust respectively constitute annular grooves for advancing and retarding 123 and 133 provided on the exhaust camshaft 6 bearing surface 4*b* of the cam cap 4. Moreover, the annular groove for retarding 113 on the intake camshaft 5 bearing surface 4*a* and the annular groove for advancing 123 on the exhaust camshaft 6 bearing surface 4*b* are respectively provided in the center in the width direction of their respective bearing surfaces 4*a* and 4*b*.

4 Claims, 18 Drawing Sheets

ENGINE VARIABLE VALVE TIMING SYSTEM

BACKGROUND OF THE INVENTION

1. Field of the Invention

The present invention relates to an engine variable valve timing system and particularly to an engine variable valve timing system equipped with a hydraulic variable intake phase mechanism and a hydraulic variable exhaust phase mechanism.

2. Description of the Related Art

Recent automotive engines are equipped with variable valve timing systems that vary the timing at which the intake and exhaust valves open and close. These variable valve timing systems typically have variable phase mechanisms that vary the phases of the camshafts with respect to the crankshaft. Such variable phase mechanisms have conventionally been disposed on the ends of the intake camshaft and the exhaust camshaft. Variable phase mechanisms comprise a sprocket linked by chain to the crankshaft, a housing formed as a unit with the sprocket and a rotor formed as a unit with a camshaft enclosed within the housing, so that an advancing hydraulic pressure chamber and a retarding hydraulic pressure chamber are formed by means of the housing and the rotor. Thus, by controlling the supply or discharge of hydraulic pressure (advancing hydraulic pressure or retarding hydraulic pressure) to or from these hydraulic pressure chambers using a control valve or the like, for example, it is possible to change the phases of the camshafts with respect to the crankshaft and as a result it is possible to vary the timing of the opening and closing of the intake and exhaust valves.

In this case, as taught by Japanese Patent Unexamined Publication (Kokai) No. JP-A-2001-50102, portions of the hydraulic lines that connect these hydraulic control valves to the advancing hydraulic pressure chamber and the retarding hydraulic pressure chamber constitute annular grooves provided on the bearing surface of the cam cap which supports the camshafts. Moreover, the advancing hydraulic pressure and the retarding hydraulic pressure are supplied from the annular grooves via hydraulic lines passing through the interior of the camshafts and on to the advancing hydraulic pressure chamber and the retarding hydraulic pressure chamber.

However, if the overlap period during which the intake and exhaust valves are both open is large such as during idling, for example, deleterious effects such as the engine speed becoming unstable may occur, so in this case, it is customary to attempt to shorten the overlap (i.e, advance the open/close timing of the exhaust valve and/or retarding the open/close timing of the intake valve) and thus suppress the suckback of exhaust from the exhaust line. On the other hand, during low and medium loads as during low-speed driving, it is customary to attempt to increase the overlap (i.e., retard the open/close timing of the exhaust valve and/or advancing the open/close timing of the intake valve) and thus improve fuel economy and the like.

However, there is the problem of the response lag of hydraulic fluid from when the signals for advance/retard control are output until the advancing hydraulic pressure and the retarding hydraulic pressure are supplied to or discharged from the advancing hydraulic pressure chamber or the retarding hydraulic pressure chamber, and the valve timing is actually advanced or retarded. In particular, when the accelerator pedal is released from a low-load to medium-load state wherein the overlap is large, it is necessary to reduce the overlap, but due to the response lag in the supply or discharge of hydraulic pressure, the state with a large overlap is maintained despite the idling state. If this happens, the engine speed becomes unstable as described above, possibly leading to a stall. More specifically, delay in the supply of retarding hydraulic pressure to the retarding hydraulic pressure chamber of the variable intake phase mechanism or delay in the supply of advancing hydraulic pressure to the advancing hydraulic pressure chamber of the variable exhaust phase mechanism may result in delayed response in advance/retard control, so when changing the overlap from large to small, it will not become small immediately.

In addition, when the previous engine halt occurred suddenly, as when going from a high-load state without adequately passing through the idling state, or in the case of a stall or the like, because of the hydraulic fluid response lag described previously, it is possible that the intake and exhaust camshafts may not have returned adequately to the side of narrow overlap (the exhaust camshaft on the advanced side, the intake camshaft on the retarded side). Even in this case, it is sufficient for the hydraulic pressure to rise at the time of the next engine start and for the camshafts to return promptly to the side of narrowing the overlap, but when the engine halts the hydraulic pumps are also halted and supply no hydraulic pressure, so while the engine is halted the hydraulic fluid is bled from the hydraulic pressure chambers and the hydraulic lines connecting these hydraulic pressure chambers to the hydraulic pressure control valves described above, so one cannot expect the hydraulic pressure to rise immediately upon the next engine start. As a result, the engine is started in the state in which the open/close timing of the intake/exhaust valves is not appropriate (the overlap is not sufficiently narrow), so there is a problem in that the engine ignition and starting performance become poor.

In particular, a return spring that constantly presses the intake and exhaust valves toward the closed side is incorporated into the engine valve train mechanism. This return spring becomes resistance to camshaft rotation and as a result, the camshaft is subject to a reaction force in the retarding direction when the valve is open. Moreover, this reaction force in the retarding direction causes the intake camshaft to be pressed in the direction of narrowing the overlap, while the exhaust camshaft is conversely pressed in the direction of enlarging the overlap. Thus, while the intake camshaft is naturally or easily returned in the retarding direction that narrows the overlap while the engine is halted or at the time of an engine start, the exhaust camshaft is not easily returned in the advancing direction that narrows the overlap.

There are further problems that may occur in variable phase mechanisms on which a lock mechanism is mounted. Specifically, this lock mechanism is defined to be one where, when the camshaft and the rotor reach the position at which the overlap is narrowest (the most advanced position on the exhaust side and most retarded position on the intake side), a lock pin provided on the rotor is pressed toward the sprocket side and engages an indentation provided on this sprocket side, so that the rotor and sprocket are linked as a unit.

At this time, this lock pin may be constituted such that it may be knocked out from this indentation when hydraulic pressure is supplied to a special hydraulic pressure chamber, and the hydraulic pressure used to knock out this lock pin is typically the hydraulic pressure supplied to the exhaust-side advancing hydraulic line and advancing hydraulic pressure chamber, namely the hydraulic pressure used for advancing. This lock mechanism is intended to keep the camshaft at the narrowest overlap position while the engine is halted (in other words, at the most preferable position for starting the engine), so it is fundamentally unnecessary while the engine is running. Moreover, immediately after the engine is started, the hydraulic pressure is controlled so as to make the overlap narrower on the exhaust side, so immediately after the engine is started, a situation occurs in which the advancing hydraulic pressure rises first while the retarding hydraulic pressure has not yet risen. Accordingly, in order to quickly unlock the lock mechanism which is no longer necessary once the engine is started, the advancing hydraulic pressure for exhaust which rises immediately after the engine is started is used to unlock the lock mechanism described above.

However, the hydraulic pumps are also halted when the engine is halted, so the hydraulic fluid that had flowed in the hydraulic lines drains downward and air enters these hydraulic lines. Moreover, when the engine is next started, on the exhaust side, the hydraulic pressure control valves exert control of the hydraulic pressure so that the exhaust camshaft moves toward the advancing side (so that the overlap becomes narrower). Specifically, on the exhaust side, hydraulic fluid is first supplied to the empty advancing hydraulic line and the advancing hydraulic pressure chamber, but hydraulic fluid is not yet supplied to the equally empty retarding hydraulic line and the retarding hydraulic pressure chamber. Moreover, at this time, the air within this hydraulic line is first pushed out by the hydraulic pressure supplied to the advancing hydraulic line, and there is a possibility that this air may knock the lock pin of this lock mechanism out from the indentation. Furthermore, at that point in time, the exhaust-side advancing hydraulic pressure (hydraulic line) and the intake-side retarding hydraulic pressure have not yet reached the advancing hydraulic pressure chamber and the retarding hydraulic pressure chamber, so ultimately problems occur wherein the rotor and camshaft positions fluctuate unstably, abnormal sounds are caused by shimmying in the direction of rotation between the rotor formed as a unit with the camshaft and the casing formed as a unit with the sprockets which form the hydraulic pressure chambers, or the position of the rotor and camshaft shifts from the advanced-side position, making the rotation during idling become unstable.

SUMMARY OF THE INVENTION

An object of the present invention is to provide a variable valve timing system that is able to reduce the overlap with good response at the time that the accelerator is returned from the low/medium load state to the idling state.

Another object of the present invention is to provide a variable valve timing system that is able to reliably return the exhaust camshaft to the advancing direction while the engine is halted or at the time of an engine start, even if the exhaust camshaft was not returned in the direction of a narrow overlap, namely the advancing direction, when the engine was halted.

In order to achieve the above object, the present invention provides an engine variable valve timing system comprising a hydraulic variable intake phase mechanism and a hydraulic variable exhaust phase mechanism respectively provided. On the ends of the intake camshaft and an exhaust camshaft that respectively vary the respective phases of these camshafts, the variable phase mechanisms respectively having advancing hydraulic pressure chambers and retarding hydraulic pressure chambers, an intake hydraulic pressure control valve and an exhaust hydraulic pressure control valve that respectively control the hydraulic pressure supplied to advancing hydraulic pressure chambers and the retarding hydraulic pressure chambers of the variable phase mechanisms, an intake-side advancing hydraulic line and an intake-side retarding hydraulic line that respectively connect the intake hydraulic pressure control valve to the advancing hydraulic pressure chamber and retarding hydraulic pressure chamber of the variable intake phase mechanism, and an exhaust-side advancing hydraulic line and an exhaust-side retarding hydraulic line that connect the exhaust hydraulic pressure control valve to the advancing hydraulic pressure chamber and retarding hydraulic pressure chamber of the variable exhaust phase mechanism, wherein portions of the intake-side advancing hydraulic line and the intake-side retarding hydraulic line respectively constitute annular grooves for advancing and retarding, respectively provided on the intake camshaft bearing surface of the cam cap which supports the camshaft, and portions of the exhaust-side advancing hydraulic line and the exhaust-side retarding hydraulic line respectively constitute annular grooves for advancing and retarding provided on the exhaust camshaft bearing surface of the cam cap which supports the camshaft, wherein the annular groove for retarding on the intake camshaft bearing surface and the annular groove for advancing on the exhaust camshaft bearing surface are respectively provided in the center in the width direction of the respective bearing surfaces.

According to this aspect of the invention, the annular groove for retarding corresponding to the variable intake phase mechanism is positioned in the center of the camshaft in the width direction, so the hydraulic fluid supplied to the retarding hydraulic pressure chamber does not easily leak to the outside from the annular groove for retarding. Accordingly, when the overlap is reduced, the loss of retarding hydraulic pressure on the intake side supplied by the control valve is reduced, thereby improving the responsiveness of this hydraulic pressure and achieving prompt retarding control on the intake side and control that reduces the overlap. In the same manner, the annular groove for advancing corresponding to the variable exhaust phase mechanism is positioned in the center of the camshaft in the width direction, so the hydraulic fluid supplied to the advancing hydraulic pressure chamber does not easily leak to the outside from these annular groove for advancing. Accordingly, when the overlap is reduced, the loss of advancing hydraulic pressure on the exhaust side supplied by the control valve is reduced, thereby improving the responsiveness of this hydraulic pressure and achieving prompt advancing control on the exhaust side and control that reduces the overlap. In this manner, when the overlap is reduced, it is possible to improve the responsiveness of the hydraulic pressure of the variable intake/exhaust phase mechanism, so the engine speed is stabilized and the occurrence of stalls is suppressed.

In the present invention, it is preferable that the annular groove for advancing on the intake camshaft bearing surface and the annular groove for retarding on the exhaust camshaft bearing surface of the cam cap are respectively provided near the edges of their respective bearing surfaces in the width direction.

According to this aspect of the invention, the annular groove for advancing corresponding to the variable intake phase mechanism is provided at a position near the edge of the cam cap in the width direction, so hydraulic fluid discharged from the advancing hydraulic pressure chamber leaks to the outside more easily from the annular grooves for advancing. Accordingly, when the overlap is reduced, in addition to the action and effect of the foregoing aspect of the invention, retarding control on the intake side can be performed even more promptly. In the same manner, the annular groove for retarding corresponding to the variable exhaust phase mechanism is provided at a position near the edges of the cam cap in the width direction, so hydraulic fluid discharged from the retarding hydraulic pressure chamber leaks to the outside more easily from the annular groove for retarding. Accordingly, when the overlap is reduced, retarding control on the exhaust side can be performed even more promptly.

Moreover, even if hydraulic pressure escapes from the hydraulic pressure chamber or hydraulic line while the engine is halted, on the exhaust camshaft side, hydraulic pressure escapes more easily from within the retarding hydraulic pressure chamber and the retarding hydraulic line than hydraulic pressure escapes from within the advancing hydraulic pressure chamber and the advancing hydraulic line, and thus because of the pressing force of the return spring incorporated into the engine valve train mechanism, in the exhaust camshaft, a situation in which it is difficult to return to the advancing direction in which the overlap becomes narrower. Accordingly, when the engine is halted, even if the exhaust camshaft does not return sufficiently in the direction in which the overlap becomes narrower, namely the advancing direction, this exhaust camshaft can be reliably and easily returned to the advancing direction while the engine is halted or at the time that the engine is started, so the engine ignition and starting performance is ensured the next time.

In the present invention, it is preferable that the annular groove for advancing on the intake side and the annular groove for retarding on the exhaust side are provided near the edges of their respective bearing surfaces in the width direction, on the side close to the respective variable phase mechanisms.

According to this aspect of the present invention, by providing the annular groove for advancing on the intake side and the annular groove for retarding on the exhaust side near the edges of their respective bearing surfaces in the width direction, the length of the hydraulic line from the advancing hydraulic pressure chamber of the variable intake phase mechanism to the annular groove for advancing and the length of the hydraulic line from the retarding hydraulic pressure chamber of the variable exhaust phase mechanism to the annular groove for retarding are shortened. As a result, the line resistance to the hydraulic fluid discharged from each hydraulic pressure chamber is reduced, so the escape of advancing hydraulic pressure on the intake side and retarding hydraulic pressure on the discharge side becomes prompt and good, so the camshaft on the exhaust side can be more reliably and easily returned to the advanced position, and the camshaft on the intake side can be more reliably and easily returned to the retarded position. The responsiveness of the control that makes the overlap smaller is therefore increased.

In the present invention, it is preferable that the variable exhaust phase mechanism is provided with a spring that presses the camshaft in the advancing direction with respect to the crankshaft-side rotating member.

According to this aspect of the invention, the spring presses the exhaust camshaft in the advancing direction, which is its direction of rotation. Thereby, it is possible to offset the one-sided force pressing the exhaust camshaft in the retarding direction (the direction of making the overlap larger) due to the reaction force of the return spring which constantly presses the exhaust valve toward the closed side.

In the present invention, it is preferable that the exhaust hydraulic pressure control valve is attached to the camshaft toward the vertical direction, and for the portion of the exhaust-side advancing hydraulic line that extends from the exhaust hydraulic pressure control valve to the annular groove is provided in a position above the portion that extends from the exhaust hydraulic pressure control valve to the annular groove.

According to this aspect of the invention, at the time that the engine is started, in the course of air being sent from the main pressure supply line via the input port and the output port in the exhaust hydraulic pressure control valve to the advancing hydraulic line, this air which is lighter than hydraulic fluid is more easily bled from the gap between the valve case of the exhaust hydraulic pressure control valve and its valve insertion hole in the cam cap, or from the gap between the hollow valve case and spool of the exhaust hydraulic pressure control valve, upward to the drain ports or the like and to the outside. Moreover, the distance from the advancing hydraulic line and the upper edge of the cam cap within which this hydraulic line is inserted becomes shorter, so air again is more easily bled to the outside from the gap between the cam cap and cover member which cooperatively form this exhaust-side advancing hydraulic line. Because of the above, the problem of the compressed air pushing out the lock pin before the advancing hydraulic pressure reaches the advancing hydraulic pressure chamber can be readily averted.

DETAILED DESCRIPTION OF THE PREFERRED EMBODIMENTS

Figure 1:
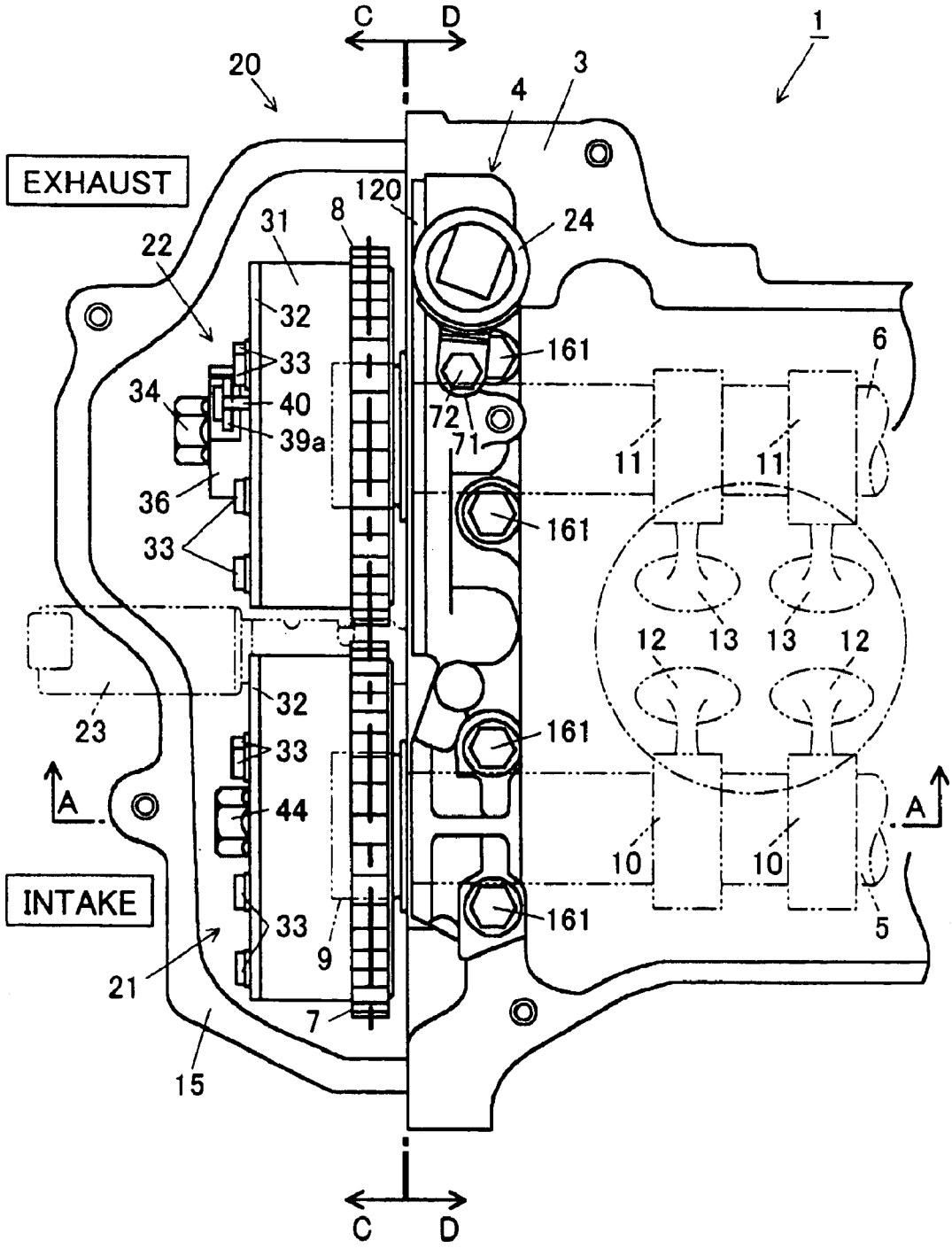
FIG. 1 is a top view showing an engine variable valve timing system according to a preferred embodiment of the present invention.
Figure 2:
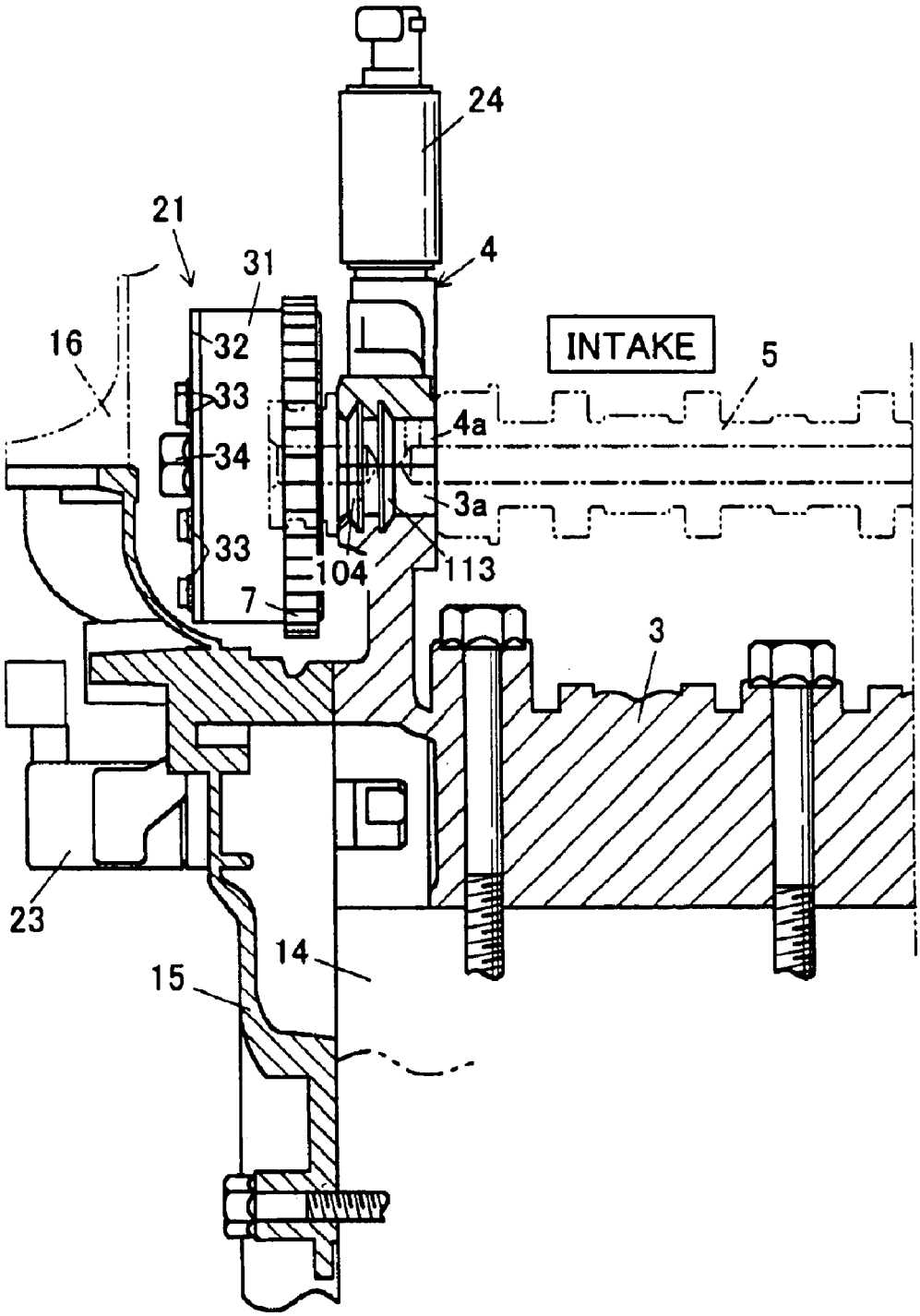
FIG. 2 shows a cross sectional view taken along a line A—A of FIG. 1.

Preferred embodiments of the present invention will now be explained. As shown in FIGS. 1 and 2, an engine 1 is provided with an intake camshaft 5 and an exhaust camshaft 6 which are disposed parallel to a crankshaft (not shown but given the reference numeral 2) and rotatably supported by a cylinder head 3 and a cam cap 4. In the vicinity of the ends of these camshafts 5 and 6, sprockets 7 and 8 which are capable of relative rotation within a stipulated range are engaged to these camshafts 5 and 6 and also a chain 9 is wound around these sprockets 7 and 8 and a sprocket on the crankshaft 2 side. Moreover, with the rotation of the chain 9, the sprockets 7 and 8 and the camshafts 5 and 6 rotate via the chain 9, and thereby, via a plurality of cams 10 and 11 (see FIG. 1) secured to each of the camshafts 5 and 6, a plurality of intake valves 12 and exhaust valves 13 are driven to open and close.

Here, as shown in FIG. 2, mounted to the cylinder block 14 and end surface of the cam cap 4 of the cylinder head 3 (end surface on the front side) is a front cover 15 that covers these end surfaces.

A variable valve timing system 20, according to an preferred embodiment of the present invention, is provided on this engine 1 (see FIG. 1). The variable valve timing system 20 is provided with a hydraulic variable intake phase mechanism 21 and variable exhaust phase mechanism 22, provided on the sprocket 7 and 8 ends of the intake camshaft 5 and the exhaust camshaft 6, respectively, that independently change the phase angle of rotation of these camshafts 5 and 6 with respect to the crankshaft 2 (specifically, the phase angle of the open and close timing of the intake valves 12 and exhaust valves 13 with respect to the crankshaft 2). Moreover, an intake hydraulic pressure control valve 23 that controls the advancing hydraulic pressure and retarding hydraulic pressure supplied to the variable intake phase mechanism 21 is mounted to the front cover 15, while an exhaust hydraulic pressure control valve 24 that controls the advancing hydraulic pressure and retarding hydraulic pressure supplied to the variable exhaust phase mechanism 22 is mounted to the cam cap 4. The two variable phase mechanisms 21 and 22 are independently controlled by these hydraulic pressure control valves 23 and 24 depending on the operating state of the engine 1.

Figure 3:
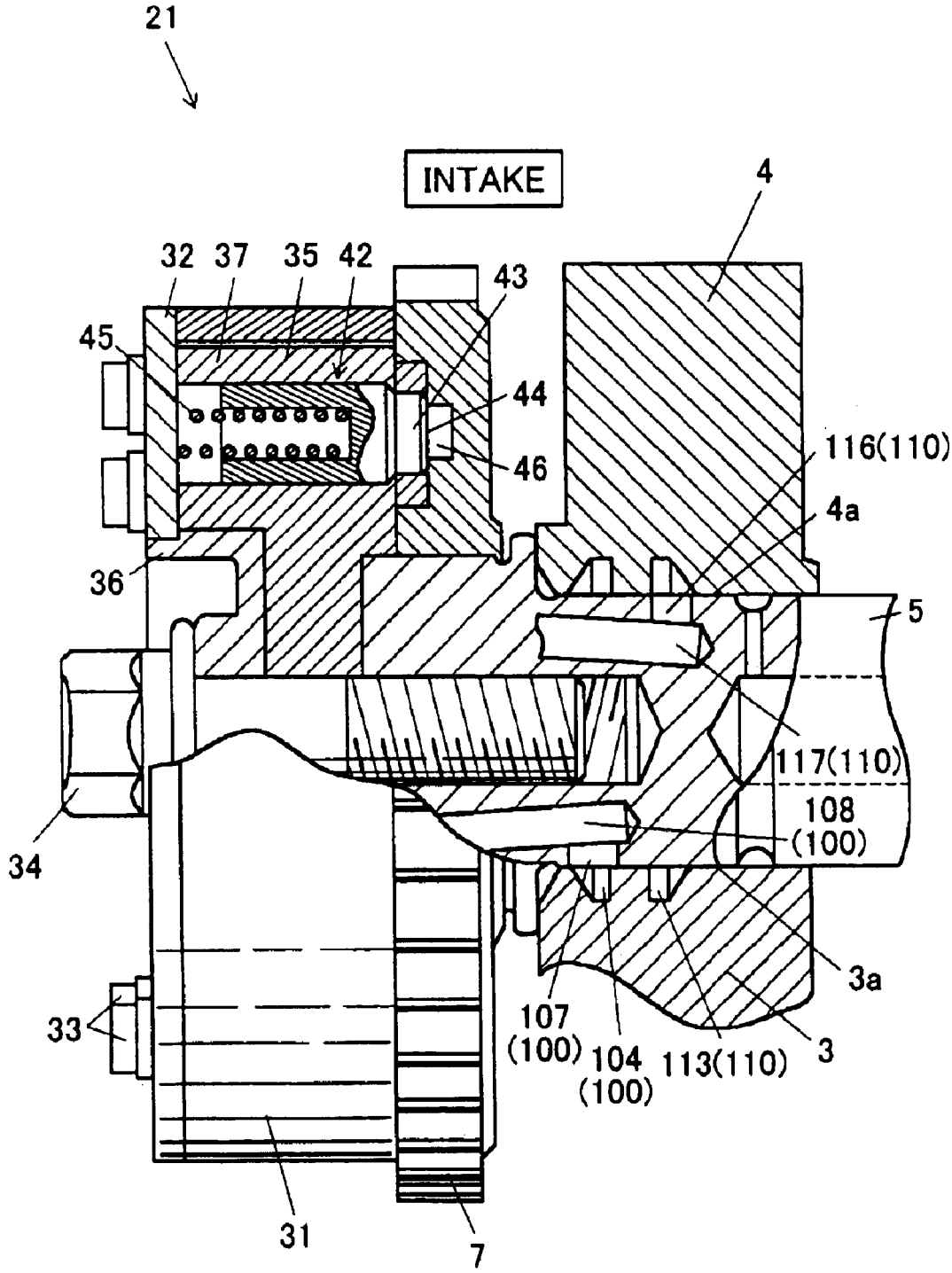
FIG. 3 is a partial cutaway enlarged cross sectional view showing the structure in the vicinity of the variable intake phase mechanism.
Figure 4:
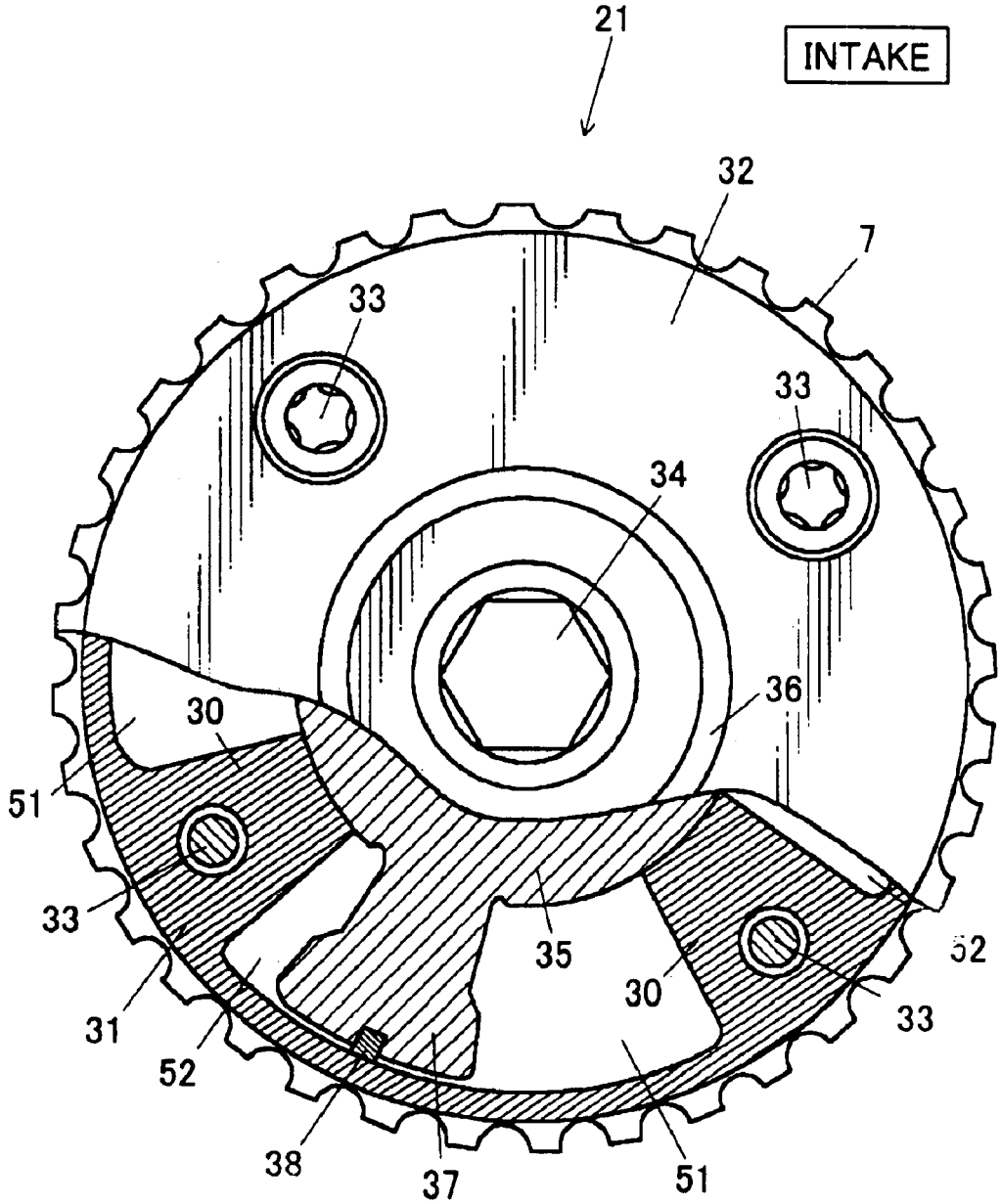
FIG. 4 is a partial cutaway enlarged cross sectional view of the variable intake phase mechanism.
Figure 5:
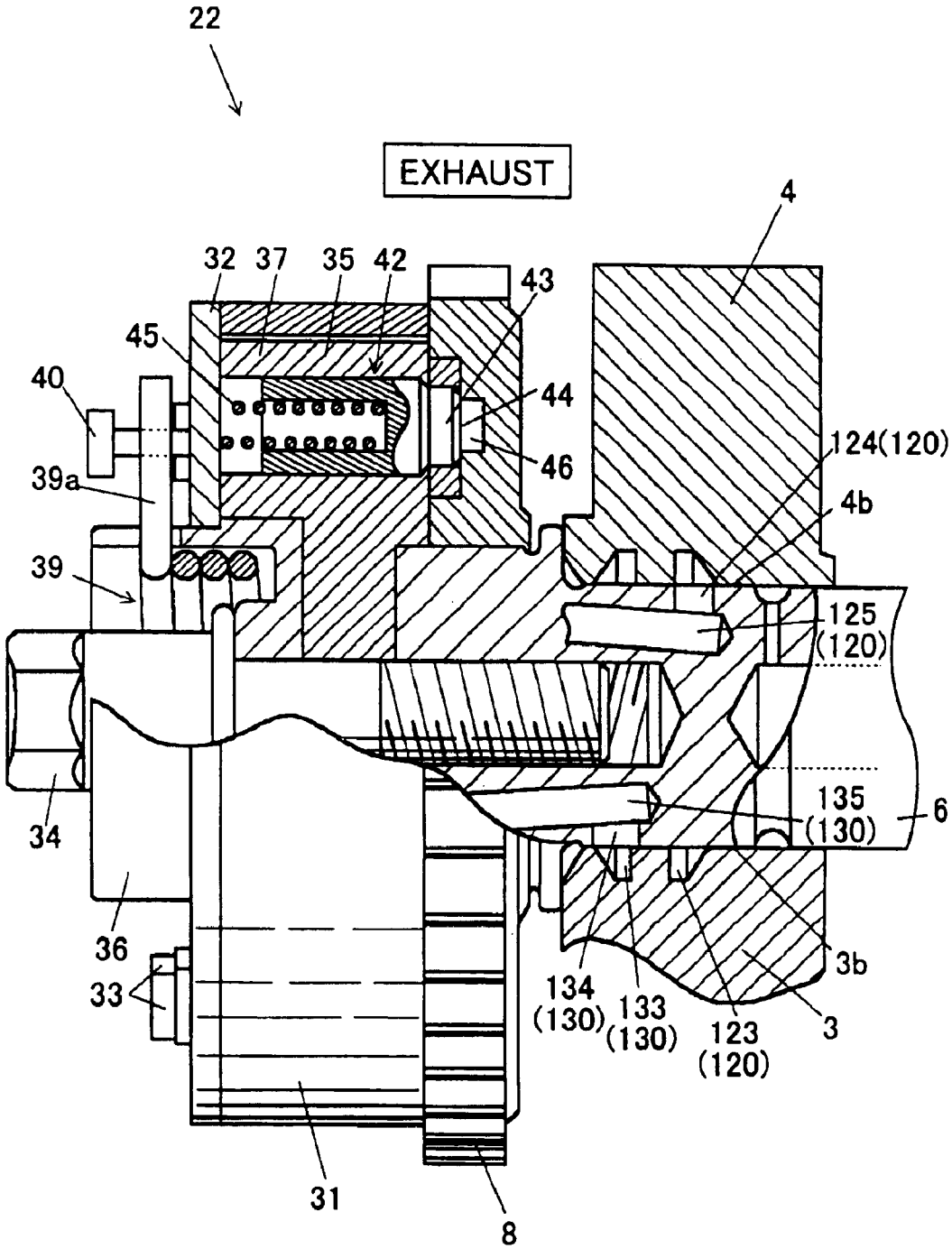
FIG. 5 is a partial cutaway enlarged cross sectional view showing the structure in the vicinity of the variable exhaust phase mechanism.
Figure 6:
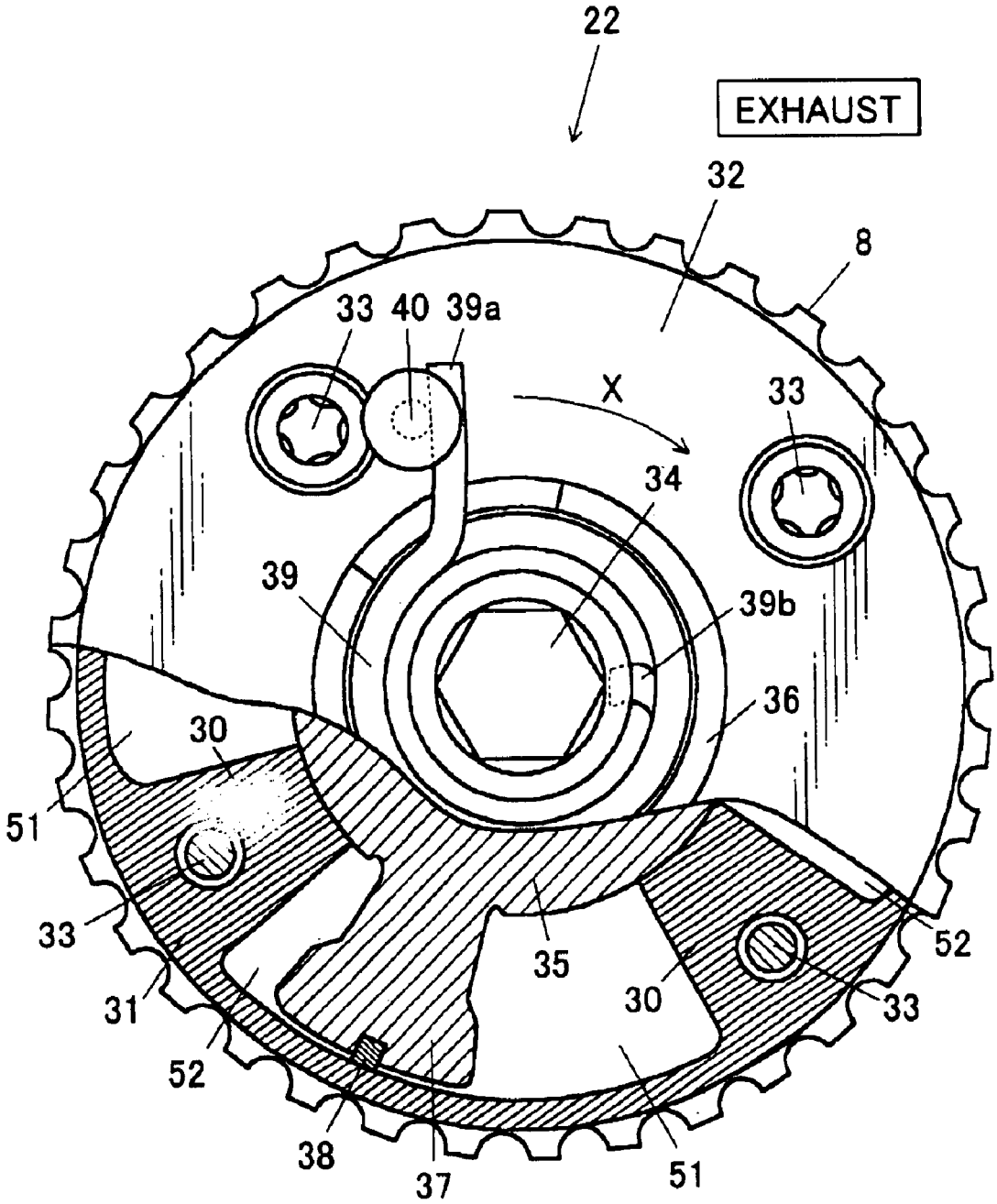
FIG. 6 is a partial cutaway enlarged cross sectional view of the variable exhaust intake phase mechanism.

Here follows an explanation of the structure of the variable phase mechanisms 21 and 22. FIGS. 3 and 4 show the variable intake phase mechanism 21 while FIGS. 5 and 6 show the variable exhaust phase mechanism 22. Each of the mechanisms 21 and 22 comprises a hollow housing 31 having a plurality of projections 30 that project toward the shaft center (only two are illustrated in FIGS. 4 and 6) and a cover member 32 for this housing 31, while the housing 31 and cover member 32 form the basic structure when secured to the sprockets 7 and 8 by a plurality of bolts 33. In addition, both of these mechanisms 21 and 22 are enclosed within the housing 31, comprising a rotor 35 that has a plurality (more specifically, the same number as the number of projections 30 on the housing 31) of engaging members 37 (only one is shown on FIGS. 4 and 6) that extend toward the periphery, and a receiving member 36 that engages the center of this rotor 35, with a structure wherein the rotor 35 and receiving member 36 are secured with a single bolt 34 to the camshafts 5 and 6 and formed as a unit. Each of the engaging members 37 divides the space enclosed by the sprockets 7 and 8, housings 31 and 31, cover members 32 and 32, and rotors 35 and 35 into an advancing hydraulic pressure chamber 51 and a retarding hydraulic pressure chamber 52. Here, an oil seal 38 is disposed upon the top surface of each of the engaging members 37.

However, as illustrated in FIGS. 5 and 6, a coiled spring 39 is mounted within the receiving member 36 in the variable exhaust phase mechanism 22. One end 39*a* of the coiled spring 39 is held by a pin 40 standing on the cover member 32 while the other end 39*b* is held by an indentation provided on the central boss portion of the receiving member 36. The coiled spring 39 presses the exhaust camshaft 6 in the advancing direction (the direction indicated by arrow X on FIG. 6) with respect to sprocket 8. Thereby, it is possible to offset the one-sided force pressing the exhaust camshaft 6 in the retarding direction (the direction of making the overlap larger) due to the reaction force of the return spring (not shown) which constantly presses the exhaust valve 13 toward the closed side.

In addition, as shown in FIGS. 3 and 5, the variable intake phase mechanism 21 and the variable exhaust phase mechanism 22 both mount a lock pin mechanism 42. This lock pin mechanism 42 comprises a lock pin 43 able to move in the axial direction that is installed within a stipulated one of the engaging members 37 of the rotor 35. The lock pin 43 is constantly pressed toward the sprocket 7 and 8 side by the return spring 45. On the sprockets 7 and 8 are formed indentations 44 into which the lock pins 43 engage when the camshafts 5 and 6 and rotor 35 reach the position at which the overlap is narrowest (the most retarded position of the intake camshaft 5 and rotor 35 on the intake side of FIG. 3 and the most advanced position of the exhaust camshaft 6 and rotor 35 on the exhaust side of FIG. 5). Moreover, a releasing hydraulic pressure chamber 46 that communicates to an advance-side hydraulic line 120 is provided on the sprocket 7 and 8 side of these indentations 44.

Here follows a description of the hydraulic pressure control valves 23 and 24 disposed upon the hydraulic lines of the variable valve timing system 20. First, with reference to FIG. 7, the exhaust hydraulic pressure control valve 24 will be described. This exhaust hydraulic pressure control valve 24 is inserted into the exhaust hydraulic pressure control valve insertion hole 24*a* of the cam cap 4 so that its axial direction extends up and down, namely in the vertical direction, and then brackets 71 and 72 are used to assemble it with the cam cap 4. The hydraulic pressure control valve 24 has a hollow valve case 68, a spool 69 that is able to move in the axial direction within this case 68, and a spring 70 that presses this spool 69 in one direction (the upward direction in the illustrated example). The amount of movement of the spool 69 in the axial direction is adjusted by means of an actuator, e.g. a solenoid, which is driven and controlled by a control unit (not shown). On the exhaust hydraulic pressure control valve 24 are provided one input port 61, two drain ports 64 and 65, an advancing output port 66 and a retarding output port 67.

Similarly, with reference to FIG. 8, the intake hydraulic pressure control valve 23 will be described. This intake hydraulic pressure control valve 23 is inserted into the intake hydraulic pressure control valve insertion hole of the front cover 15 so that its axial direction extends horizontally, and then brackets 82 and 83 are used to assemble it with the front cover 15. The intake hydraulic pressure control valve 23 has a hollow valve case, a spool that is able to move in the axial direction within this case, and a spring that presses this spool in one direction. The amount of movement of the spool in the axial direction is adjusted by means of an actuator, e.g. a solenoid, which is driven and controlled by a control unit (not shown). On the intake hydraulic pressure control valve 23 are provided one input port 84, two drain ports 88 and 89, an advancing output port 86 and a retarding output port 87.

Next, with reference to FIGS. 9–20, the hydraulic lines of this variable valve timing system 20 will be described. The main hydraulic lines of this variable valve timing system 20 are an intake-side advancing hydraulic line 100 and the retarding hydraulic line 110 that reach from the intake hydraulic pressure control valve 23 to the advancing hydraulic pressure chamber 51 and the retarding hydraulic pressure chamber 52, respectively, of the variable intake phase mechanism 21, and an exhaust-side advancing hydraulic line 120 and the retarding hydraulic line 130 that reach from the exhaust hydraulic pressure control valve 24 to the advancing hydraulic pressure chamber 51 and the retarding hydraulic pressure chamber 52, respectively, of the variable exhaust phase mechanism 22.

Figure 9:
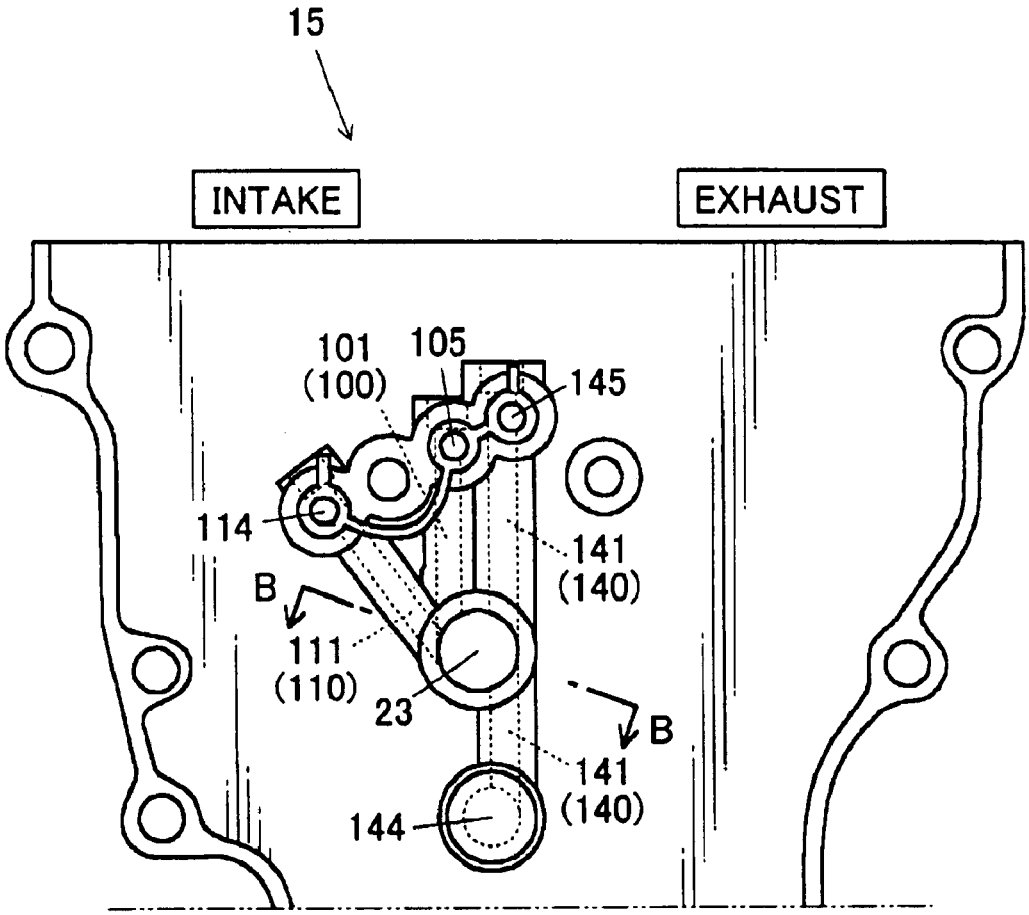
FIG. 9 is a rear view of the front cover illustrating the hydraulic lines formed on the front cover side, taken roughly along the line C—C of FIG. 1.
Figure 10:
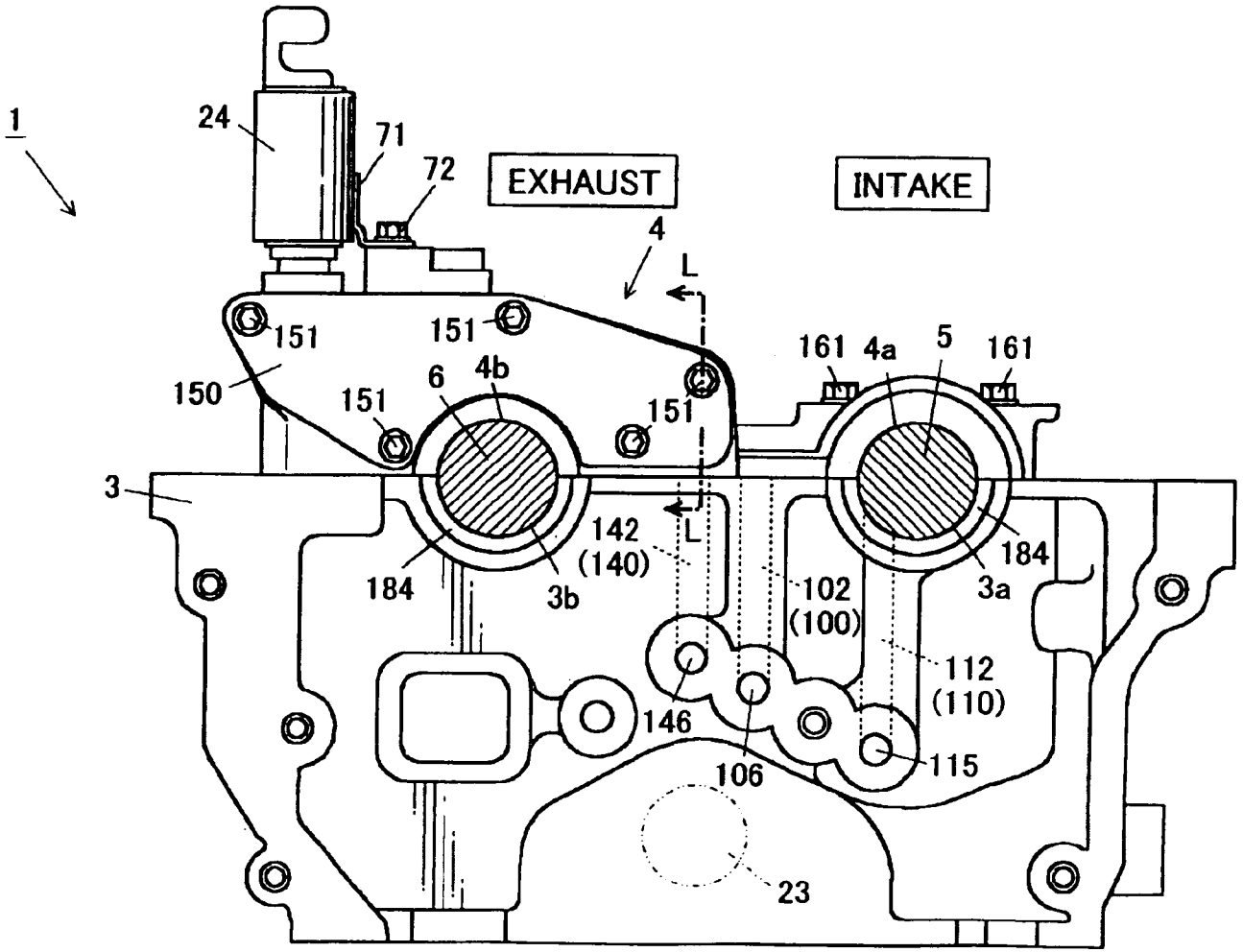
FIG. 10 is a front view of the end of the variable phase mechanism of the cylinder head illustrating the hydraulic lines formed on the cylinder head side, taken roughly along the line D—D of FIG. 1.
Figure 11:
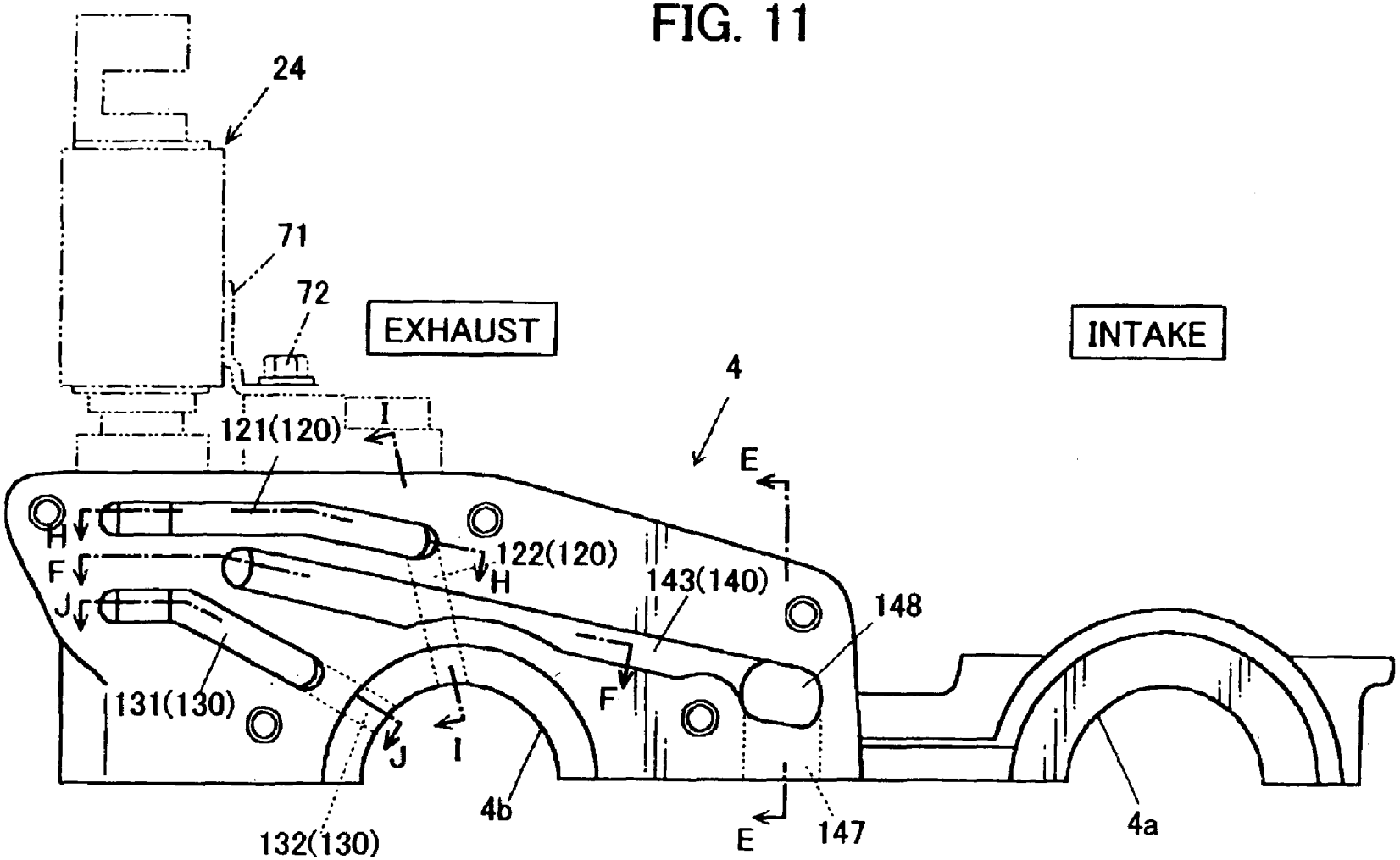
FIG. 11 is a front view of the cam cap illustrating the hydraulic lines formed on the cam cap.

First, the main pressure supply line 140 is provided with a first vertical hydraulic line 141 formed in the front cover 15 shown in FIG. 9, a second vertical hydraulic line 142 formed in the cylinder head 3 shown in FIG. 10 and a horizontal hydraulic line 143 formed in the cam cap 4 shown in FIG. 11. As shown in FIG. 9, the lower end of the first vertical hydraulic line 141 communicates with a hydraulic hole 144 that is open on the front side of the front cover 15 and communicates with the hydraulic pressure source (not shown). The upper end of the first vertical hydraulic line 141 communicates with the lower end of the second vertical hydraulic line 142 via a first horizontal hydraulic line 145 extending toward the front in FIG. 9 and a second horizontal hydraulic line 146 extending toward the back in FIG. 10 (see FIG. 12).

Here, as shown in FIG. 9, the intake hydraulic pressure control valve 23 is disposed upon the first vertical hydraulic line 141. As shown in FIG. 8, the first vertical hydraulic line 141 connects to the input port 84 of the intake hydraulic pressure control valve 23.

Figure 7:
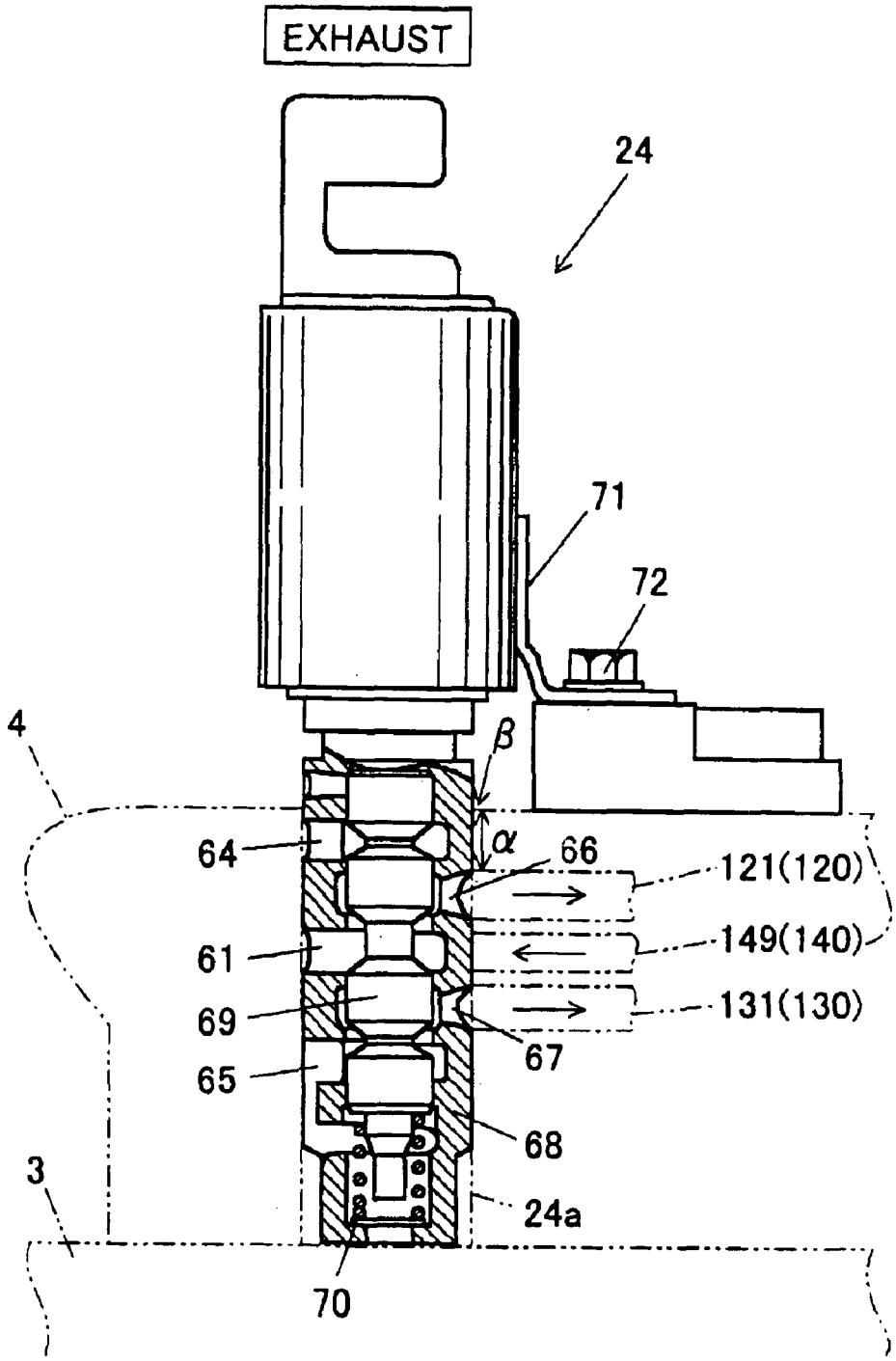
FIG. 7 is a partial cutaway front view of the exhaust hydraulic pressure control valve showing the structure of the valve.
Figure 13:
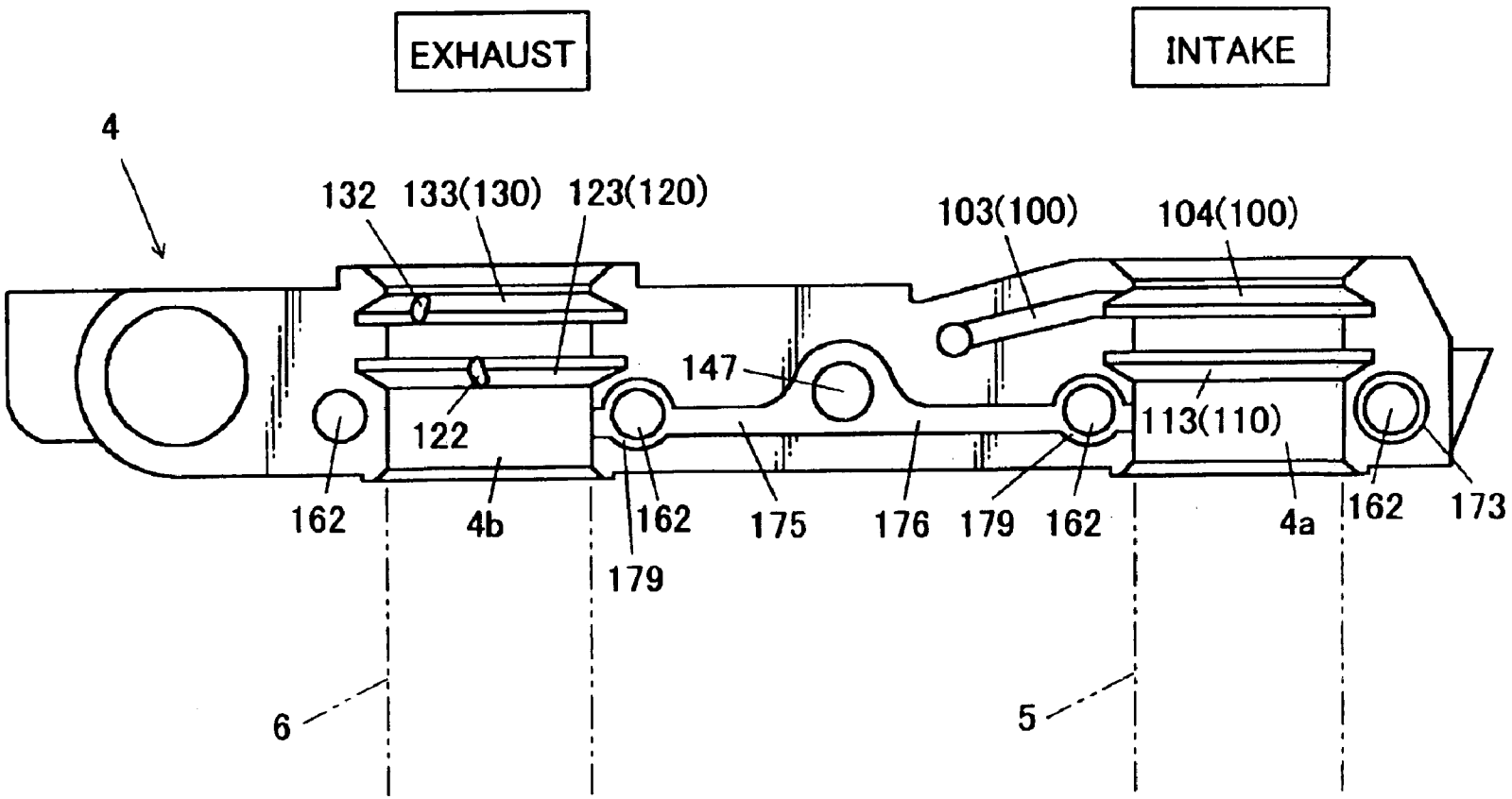
FIG. 13 is a bottom view of the cam cap illustrating the hydraulic lines formed on the cam cap.
Figure 14:
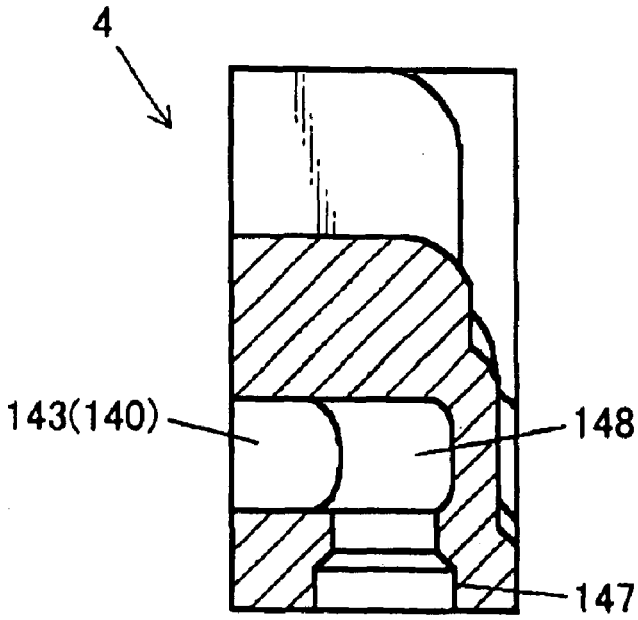
FIG. 14 shows a cross sectional view taken along a line E—E of FIG. 11.
Figure 15:
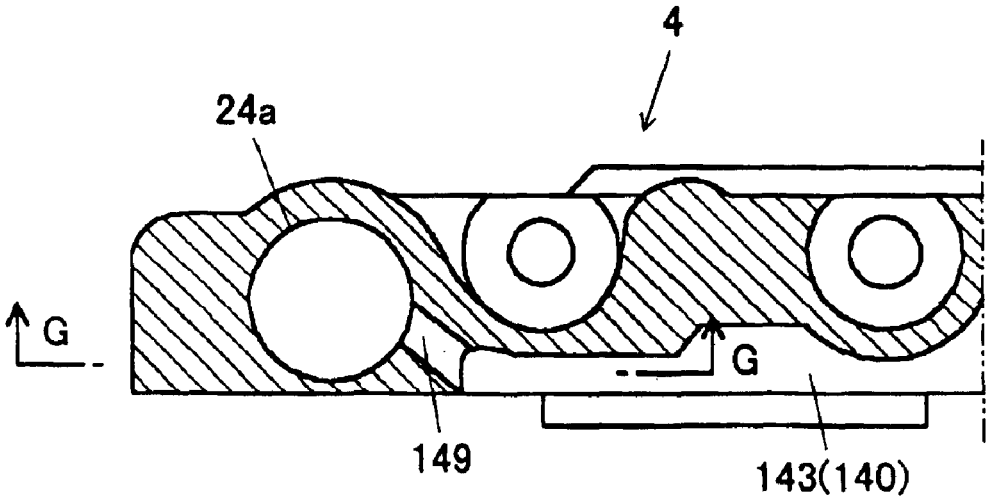
FIG. 15 shows a cross sectional view taken along a line F—F of FIG. 11.
Figure 16:
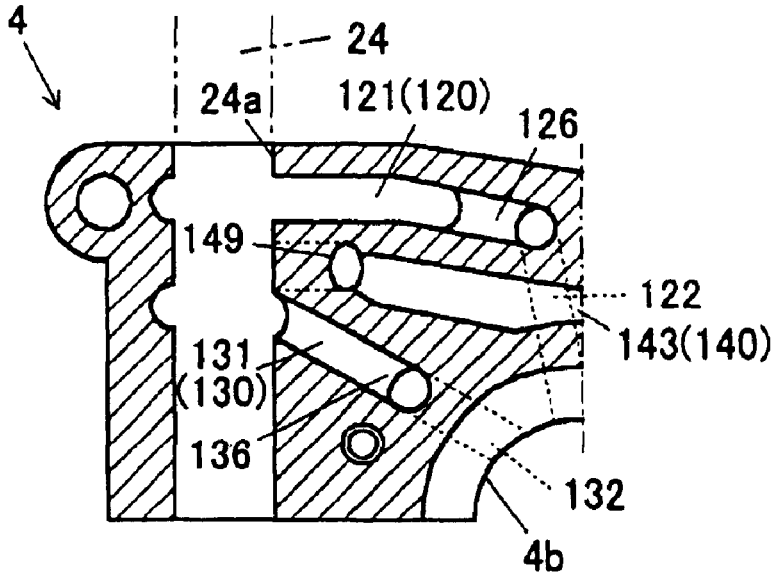
FIG. 16 shows a cross sectional view taken along a line G—G of FIG. 11.

The upper end of the second vertical hydraulic line 142 communicates with one end of the horizontal hydraulic line 143 via a vertical connection line 147 open on the bottom surface of the cam cap 4 as shown in FIGS. 13 and 14, and a horizontal connection line 148 that extends toward the front in FIG. 11 as shown in FIGS. 11 and 15. Moreover, the other end of the horizontal hydraulic line 148 is connected to the input port 61 of the exhaust hydraulic pressure control valve 24 via communication line 149 as shown in FIGS. 7, 15 and 16.

Figure 12:
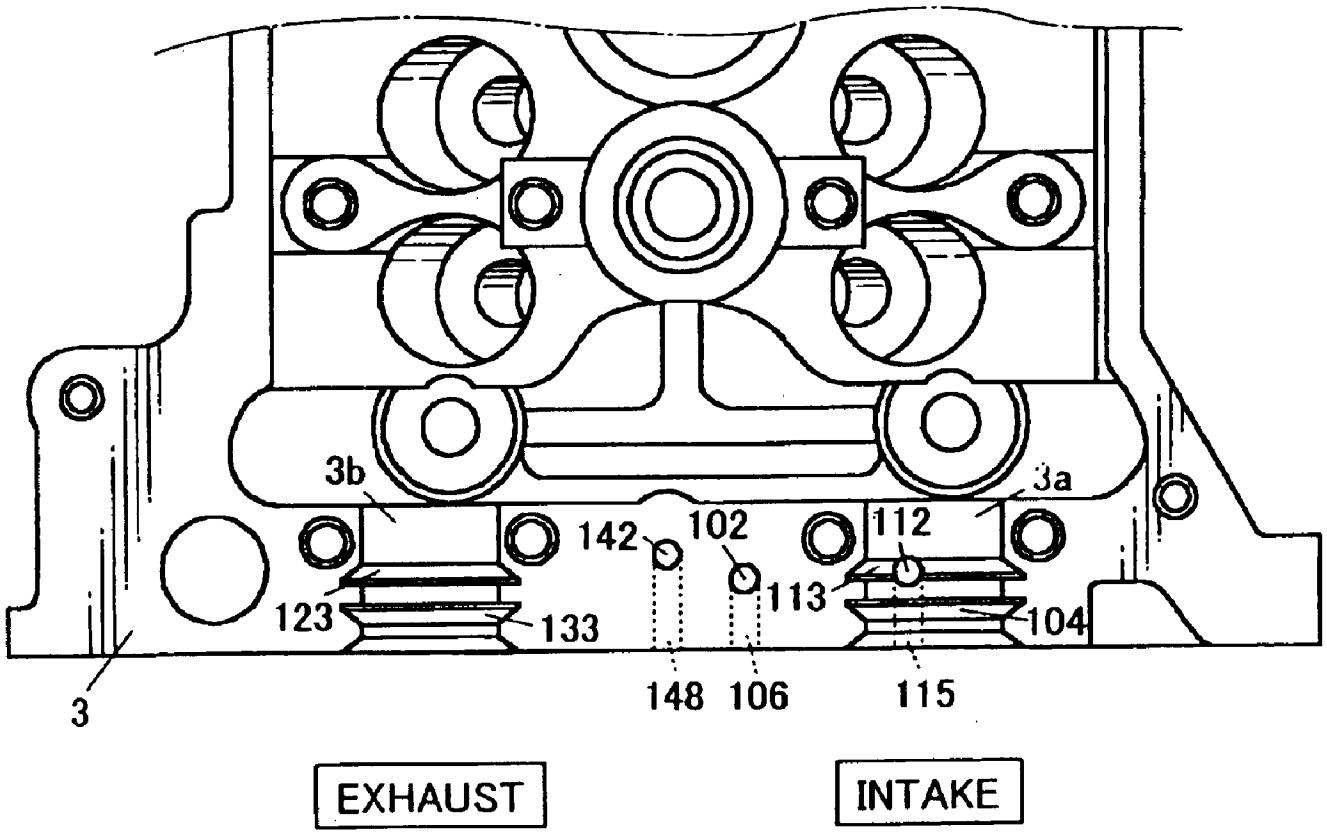
FIG. 12 is a top view of the end of the variable phase mechanism of the cylinder head similarly illustrating the hydraulic lines formed on the cylinder head side.

The intake-side advancing hydraulic line 100 and the retarding hydraulic line 110 will now be described. First, the advancing hydraulic line 100 is provided with a first vertical hydraulic line 101 formed on the front cover 15 shown in FIG. 9, a second horizontal hydraulic line 102 formed on the cylinder head 3 shown in FIG. 10, a horizontal hydraulic line 103 formed on the bottom surface of the cam cap 4 shown in FIG. 13, and an annular groove 104 similarly formed on a bearing surface 4*a* for the intake camshaft 5 in the cam cap 4. Here, as shown in FIGS. 2 and 12, on the cylinder head 3 side also, an annular groove 104 is formed on a bearing surface 3*a* for the intake camshaft 5 corresponding to the annular groove 104 on the cam cap 4 side (the same reference numeral 104 is assigned to both the annular groove on the cam cap 4 side and the annular groove on the cylinder head 3 side; the same applies to other annular grooves).

Figure 8:
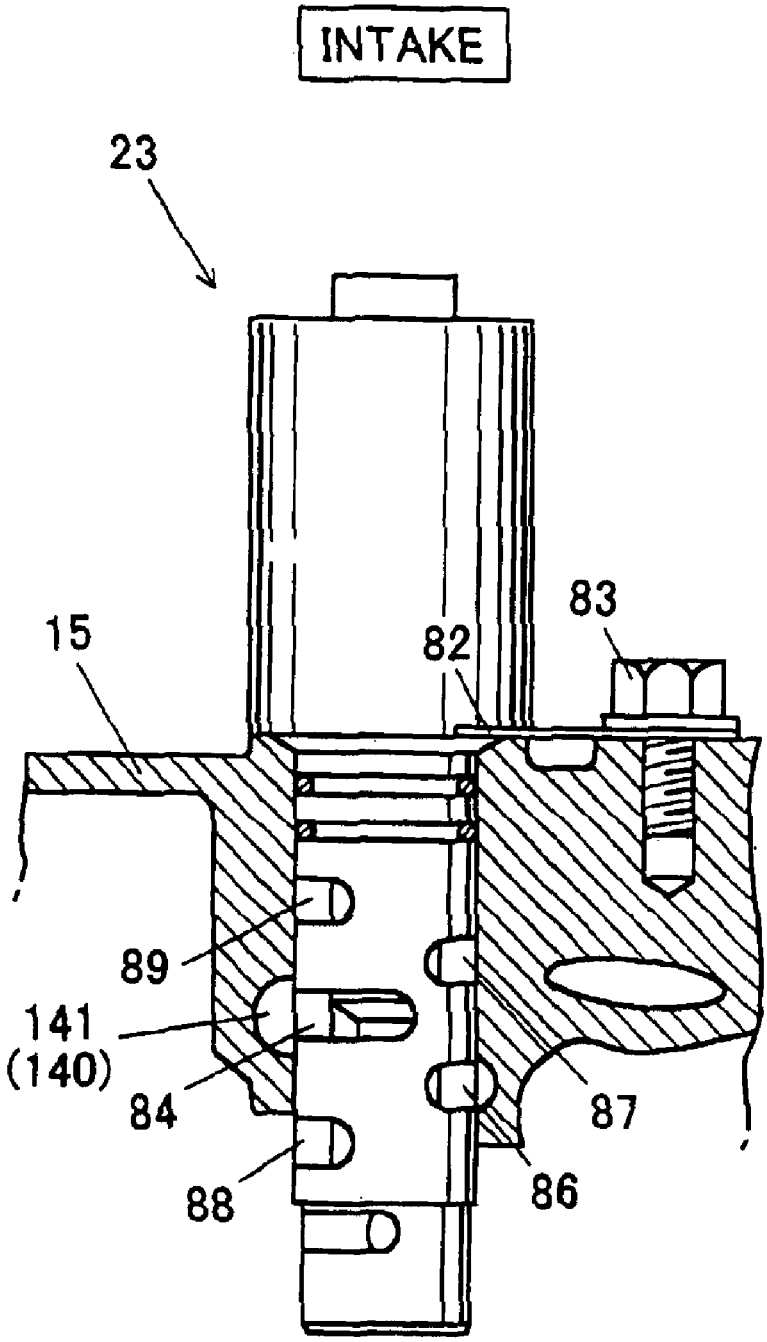
FIG. 8 shows a cross sectional view taken along a line B—B of FIG. 9 showing the appearance of the intake hydraulic pressure control valve.

As shown in FIG. 9, the lower end of the first vertical hydraulic line 101 is linked to the intake hydraulic pressure control valve 23 and connected to the advancing output port 86 shown on FIG. 8. The upper end of the first vertical hydraulic line 101 communicates with the lower end of a second horizontal hydraulic line 102 via a first horizontal hydraulic line 105 extending toward the front in FIG. 9 and a second horizontal hydraulic line 106 extending toward the back in FIG. 10 (see FIG. 12).

The upper end of the second horizontal hydraulic line 102 communicates with one end of the horizontal hydraulic line 103 and the other end of this horizontal hydraulic line 103 is connected to the annular groove 104. Here, this intake-side advancing annular groove 104 is provided near the edges of the bearing surfaces 3*a* and 4*a* in the width direction (in other words, in the thickness direction of the cam cap 4; indicating the up and down direction in FIG. 13 and the left and right direction in FIGS. 1 and 2). In addition, in this case, it is provided near the edges of bearing surfaces 3*a* and 4*a* in the width direction on the side close to the variable intake phase mechanism 21 shown in FIG. 1 (the right side in FIG. 1 and the top side in FIG. 13).

Moreover, as is clear from FIG. 3, the annular groove 104 communicates with the advancing hydraulic pressure chamber 51 of the variable intake phase mechanism 21 shown in FIG. 4 via a vertical hydraulic line 107 that opens on the peripheral surface of the intake camshaft 5 and a horizontal hydraulic line 108 that extends in the axial direction within this intake camshaft 5.

Next, the retarding hydraulic line 110 is provided with a diagonal hydraulic line 111 formed on the front cover 15 shown in FIG. 9, a vertical hydraulic line 112 formed on the cylinder head 3 shown in FIG. 10, and an annular groove 113 formed on the bearing surface 3*a* for the intake camshaft 5 in the cylinder head 3 shown in FIG. 12. Here, as shown in FIGS. 2 and 13, on the cam cap 4 side also, an annular groove 113 is formed on the bearing surface 4*a* for the intake camshaft 5 corresponding to the annular groove 113 on the cylinder head 3 side.

As shown in FIG. 9, the lower end of the diagonal hydraulic line 111 is linked to the intake hydraulic pressure control valve 23 and connected to the retarding output port 87 shown on FIG. 8. The upper end of the diagonal hydraulic line 111 communicates with the lower end of the horizontal hydraulic line 112 via a first horizontal hydraulic line 114 extending toward the front in FIG. 9 and a second horizontal hydraulic line 115 extending toward the back in FIG. 10 (see FIG. 12). The upper end of the vertical hydraulic line 112 is connected to the annular groove 113 of the cylinder head 3 shown in FIG. 12. Here, the intake-side advancing annular groove 113 is provided in the center of the bearing surfaces 3*a* and 4*a* in the width direction.

Moreover, as is clear from FIG. 3, the annular groove 113 communicates with the retarding hydraulic pressure chamber 52 of the variable intake phase mechanism 21 shown in FIG. 4 via a vertical hydraulic line 116 that opens on the peripheral surface of the intake camshaft 5 and a horizontal hydraulic line 117 that extends in the axial direction within this intake camshaft 5.

Next, the exhaust-side advancing hydraulic line 120 and the retarding hydraulic line 110 will now be described. First, the advancing hydraulic line 120 is provided with a horizontal hydraulic line 121 formed at a high position on the cam cap 4 shown in FIG. 11, an internal hydraulic line 122 similarly formed on the cam cap 4, and an annular groove 123 formed on a bearing surface 4*b* for the exhaust camshaft 6 in the cam cap 4 shown in FIG. 13. Here, as shown in FIG. 12, on the cylinder head 3 side also, an annular groove 123 is formed on a bearing surface 3*b* for the exhaust camshaft 6 corresponding to the annular groove 123 on the cam cap 4 side.

Figure 17:
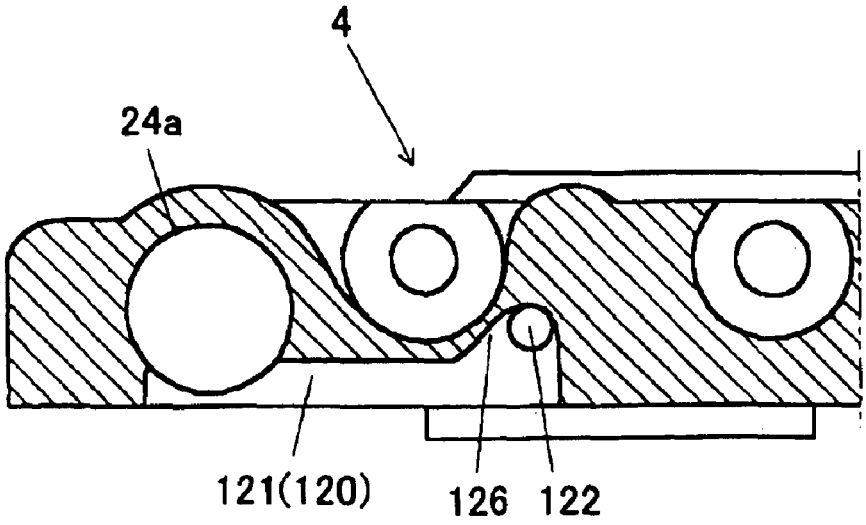
FIG. 17 shows a cross sectional view taken along a line H—H of FIG. 11.
Figure 18:
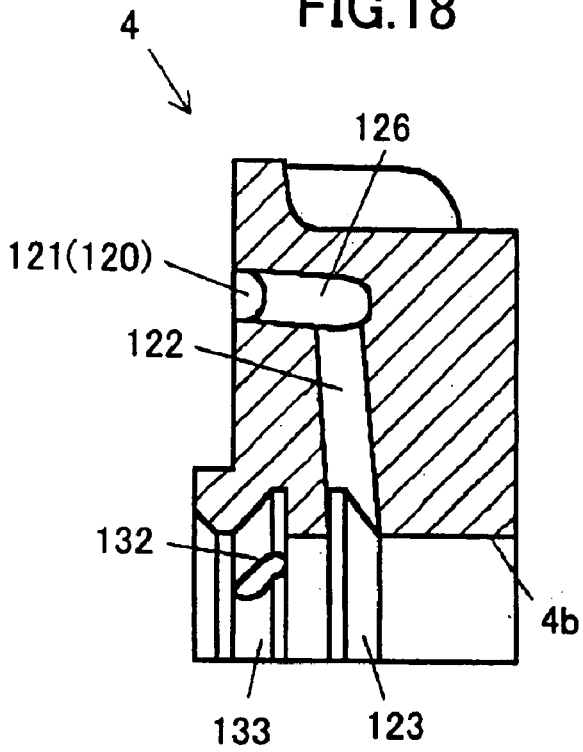
FIG. 18 shows a cross sectional view taken along a line I—I of FIG. 11.

As shown in FIGS. 7 and 17, one end of the horizontal hydraulic line 121 is linked to the exhaust hydraulic pressure control valve 24 and connected to the advancing output port 66 shown on FIG. 8. As shown in FIGS. 17 and 18, the other end of the horizontal hydraulic line 121 has a deeply formed place 126 at an upper position on the bearing surface 4*b* of the exhaust camshaft 6, and this deeply formed place 126 communicates with the upper end of an internal hydraulic line 122 as shown in FIG. 11, and the lower end of this internal hydraulic line 122 is connected to the annular groove 123 shown in FIG. 13. Here, this exhaust-side advancing annular groove 123 is provided in the center of the bearing surfaces 3*b* and 4*b* in the width direction.

Moreover, as is clear from FIG. 5, the annular groove 123 communicates with the advancing hydraulic pressure chamber 51 of the variable exhaust phase mechanism 22 shown in FIG. 6 via a vertical hydraulic line 124 that opens on the peripheral surface of the exhaust camshaft 6 and a horizontal hydraulic line 125 that extends in the axial direction within this exhaust camshaft 6.

Next, retarding hydraulic line 130 is provided with a horizontal hydraulic line 131 formed at a low position on the cam cap 4 shown in FIG. 11, an internal hydraulic line 132 similarly formed on the cam cap 4, and an annular groove 133 formed on the bearing surface 4*b* for the exhaust camshaft 6 in the cam cap 4 shown in FIG. 13. Here, as shown in FIG. 12, on the cylinder head 3 side also, an annular groove 133 is formed on the bearing surface 3*b* for the exhaust camshaft 6 corresponding to the annular groove 133 on the cam cap 4 side.

Figure 19:
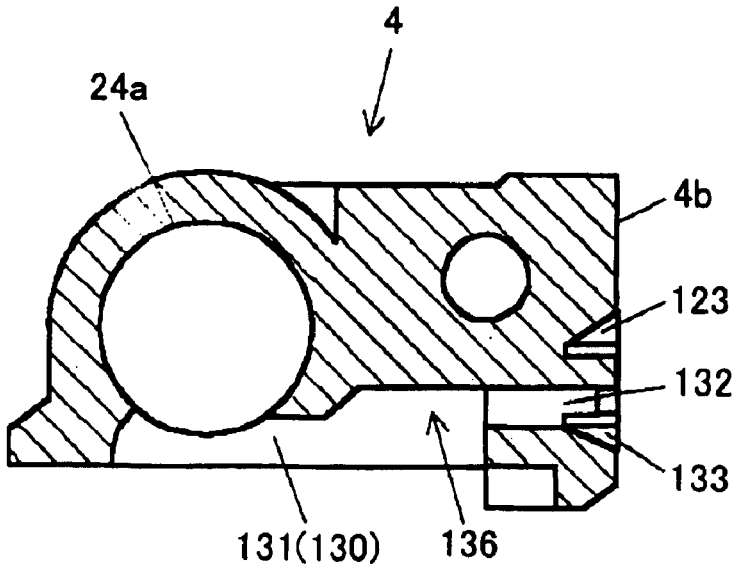
FIG. 19 shows a cross sectional view taken along a line J—J of FIG. 11.

As shown in FIGS. 7 and 19, one end of the horizontal hydraulic line 131 is linked to the exhaust hydraulic pressure control valve 24 and connected to the retarding output port 67. As shown in FIG. 19, the other end of the horizontal hydraulic line 131 has an even more deeply formed place 136 than the one end linked to the exhaust hydraulic pressure control valve 24 at a position close to the bearing surface 4*b* of the exhaust camshaft 6, and this deeply formed place 136 communicates with the upper end of the internal hydraulic line 132 as shown in FIGS. 11 and 19, and the lower end of this internal hydraulic line 132 is connected to the annular groove 133 shown in FIG. 13. Here, this exhaust-side retarding annular groove 133 is provided near the edge of the bearing surfaces 3*b* and 4*b* in the width direction. In addition, in this case, it is provided near the edge of the bearing surfaces 3*b* and 4*b* in the width direction on the side close to the variable exhaust phase mechanism 22 shown in FIG. 1.

Moreover, as is clear from FIG. 5, the annular groove 133 communicates with the retarding hydraulic pressure chamber 52 of the variable exhaust phase mechanism 22 shown in FIG. 6 via a vertical hydraulic line 134 that opens on the peripheral surface of the exhaust camshaft 6 and a horizontal hydraulic line 135 that extends in the axial direction within this exhaust camshaft 6.

Here, as shown in FIG. 10, the end surface of the exhaust side of the cam cap 4 is covered with a cover 150 (also see FIG. 1).

Figure 20:
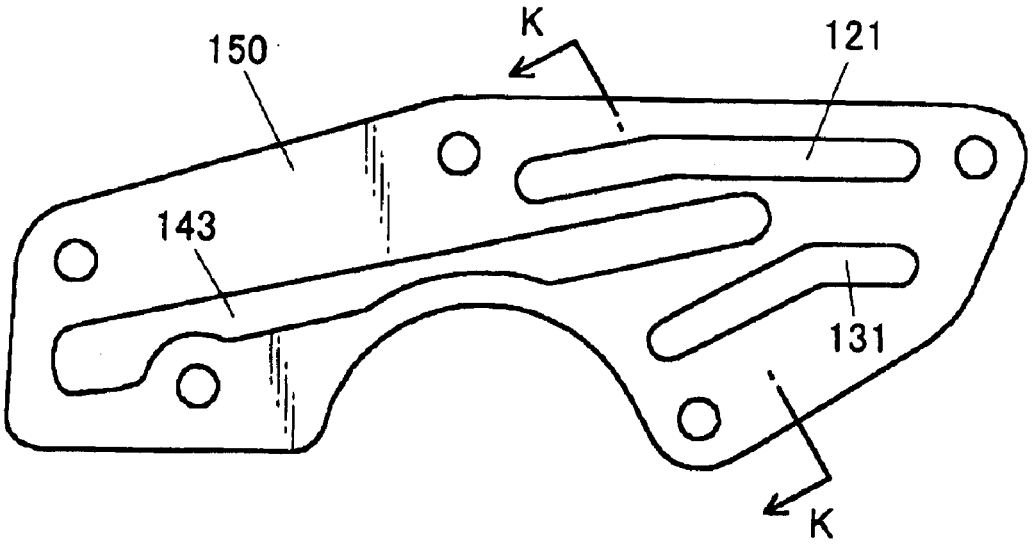
FIG. 20 is a rear view of the cover member (mating surface with the cam cap)
Figure 21:
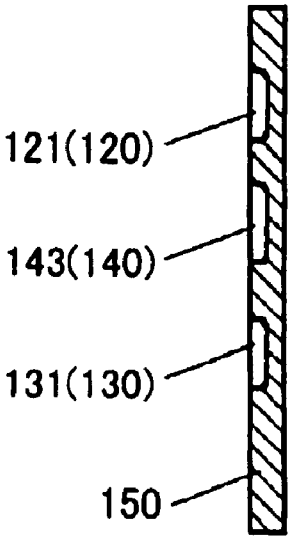
FIG. 21 shows a cross sectional view taken along a line K—K of FIG. 20.

As described above, the three horizontal hydraulic lines 121, 131 and 143 are formed on the front surface of cam cap 4 (the mating surface with cover member 150) as shown in FIG. 11. In addition, as shown in FIGS. 20 and 21, the same three horizontal hydraulic lines 121, 131 and 143 are formed on the rear surface of cover member 150 (the mating surface with cam cap 4) in a mirror-image of the horizontal hydraulic lines 121, 131 and 143 above. Moreover, as shown in FIG. 10, by brining this cam cap 4 and cover member 150 into close contact and fastening with a plurality of bolts 151, the horizontal hydraulic lines 121, 131 and 143 are brought together, thereby forming portions of the main pressure supply line 140, exhaust-side advancing hydraulic line 120 and retarding hydraulic line 130 described above. At this time, in the same manner as in the case of the exhaust hydraulic pressure control valve 24, the hydraulic lines are disposed in the order, from above, exhaust-side advancing hydraulic line 120, main pressure supply line 140 and retarding hydraulic line 130. Specifically, the exhaust-side advancing hydraulic line 120 is provided at a position above that of the retarding hydraulic line 130.

In addition, as shown in FIG. 10, the cam cap 4 is fastened by bolts 161 to the variable phase mechanisms 21 and 22 of the cylinder head 3 (also see FIG. 1). FIG. 13 illustrates the penetration holes 162 for these bolts 161 formed in the cam cap 4.

The operation of the embodiment of the present invention will now be described. First, to describe the operation of the variable phase mechanisms 21 and 22, as shown in FIGS. 4 and 6, the rotor 35 is able to rotate relative to the sprockets 7 and 8, the housing 31 and the cover member 32 within a stipulated range until the engaging members 37 touch the projections 30. Thereby, the phase angle of rotation of the camshafts 5 and 6 with respect to the sprockets 7 and 8 and the crankshaft 2 can be changed, so the open/close timing of the intake valves 12 and the exhaust valves 13 with respect to the crankshaft 2 can be changed. In addition, the coiled spring 39 presses the exhaust camshaft 6 in the advancing direction X which is its direction of rotation. Thereby, the reaction force of the return spring (not shown) which constantly presses the exhaust valves 13 toward the closing side relaxes the pressing of the exhaust camshaft 6 in the retarding direction (the direction of making the overlap larger).

Here follows a description of the operation by which the advancing hydraulic pressure and the retarding hydraulic pressure are supplied to the advancing hydraulic pressure chamber 51 and retarding hydraulic pressure chamber 52, respectively, of the variable phase mechanisms 21 and 22. In the engine 1, based on various parameters including the engine speed, the throttle position, the temperature and the like, the two hydraulic pressure control valves 23 and 24 are used to supply the advancing hydraulic pressure and the retarding hydraulic pressure to the advancing hydraulic pressure chamber 51 and the retarding hydraulic pressure chamber 52, respectively, of the variable phase mechanisms 21 and 22, thereby controlling the open/close timing of the intake valves 12 and exhaust valves 13 shown in FIG. 1, and as a result the power performance of the engine 1 and the like is optimized. For example, if the amount of air intake is made small during idling or at low temperatures, so that the overlap between the intake valves 12 and the exhaust valves 13 is large, combustion gases are blown back into the intake side, thus becoming a hindrance to intake, so in this case, it is desirable to make the overlap smaller, suppress the admixture of combustion gases and stabilize combustion. On the other hand, at low and medium loads, it is desirable to increase the amount of air intake while enlarging overlap and also increase the internal EGR, thus maintaining power while improving fuel economy. Similarly, at high loads, if the overlap is small then sufficient intake is not obtained so the intake filling efficiency becomes poor, so it is desirable to enlarge the overlap at high loads to increase the efficiency of the engine.

Accordingly, if we now assume that the accelerator pedal is returned from the low load to medium load state in which the overlap is large, the control of changing the overlap of the intake/exhaust valves 12 and 13 from large to small is exerted. On the intake side, this is the operation of shifting the intake camshaft 5 from the advanced state to the retarded state, and on the exhaust side, this is the operation of shifting the exhaust camshaft 6 from the retarded state to the advanced state.

First, on the intake side, the spool of the intake hydraulic pressure control valve 23 shown in FIG. 8 moves in the axial direction and as a result, the advancing output port 86 reduces the degree of communication with the input port 84 and conversely increases the degree of communication with the drain port 88. For this reason, the advancing hydraulic pressure output from the advancing output port 86 to the intake-side advancing hydraulic line 100 shown in FIG. 9 decreases. On the other hand, the retarding output port 87 increases the degree of communication with the input port 84 and conversely decreases the degree of communication with the drain port 89. For this reason, the retarding hydraulic pressure output from the retarding output port 87 to the retarding hydraulic line 110 shown in FIG. 9 increases. Thereby, the hydraulic pressure within the advancing hydraulic pressure chamber 51 of the variable intake phase mechanism 21 shown in FIG. 4 decreases and the hydraulic pressure within the retarding hydraulic pressure chamber 52 increases and the rotor 35 and intake camshaft 5 are displaced toward the retarded side relative to the housing 31 and the crankshaft 2.

In contrast, on the exhaust side, the spool 69 of the exhaust hydraulic pressure control valve 24 shown in FIG. 7 moves in the axial direction and as a result, the advancing output port 66 increases the degree of communication with the input port 61 and conversely decreases the degree of communication with the drain port 64. For this reason, the advancing hydraulic pressure output from the advancing output port 66 to the exhaust-side advancing hydraulic line 120 decreases. On the other hand, the retarding output port 67 decreases the degree of communication with the input port 61 and conversely increases the degree of communication with the drain port 65. For this reason, the retarding hydraulic pressure output from the retarding output port 67 to the retarding hydraulic line 130 decreases. Thereby, hydraulic pressure is supplied from the vertical hole 124 provided in the exhaust camshaft 6 through the horizontal hole 125 within the exhaust camshaft 6 to the advancing hydraulic pressure chamber 51. At this time, the hydraulic fluid that had been accumulated in advance in the retarding hydraulic pressure chamber 52 by the rotor 35 moving to the advancing side simultaneously receives hydraulic pressure from the advancing hydraulic pressure chamber 51 and is returned to the oil pan. This hydraulic fluid in the retarding hydraulic pressure chamber 52 passes through the horizontal hole 135 and vertical hole 134 in the cam cap 4 and is discharged from the drain port 65 of the exhaust hydraulic pressure control valve 24 to the outside of the camshaft bearing 184. However, a portion of the hydraulic fluid leaks to the outside from areas such as the gap between the bearing surface 4*b* of the cam cap 4 and the peripheral surface of the camshaft 6, the gap between the bearing surface 3*b* of the cylinder head 3 and the peripheral surface of the camshaft 6, or the gap between the mating surfaces of the cam cap 4 and cylinder head 3 and the peripheral surface of the camshaft 6, for example. In this manner, the hydraulic pressure increases within the advancing hydraulic pressure chamber 51 of the variable exhaust phase mechanism 22 shown in FIG. 6, the hydraulic pressure decreases within the retarding hydraulic pressure chamber 52, and the rotor 35 and the exhaust camshaft 6 are displaced toward the advancing side with respect to the housing 31 and the crankshaft 2.

When the exhaust hydraulic pressure control valve 24 is controlled so that the spool 69 moves downward in FIG. 7, the retarding hydraulic line 130 and the main pressure supply line 140 on the edge surface of the cam cap 4 communicate via the input port 61 so that hydraulic pressure is supplied to the retarding annular groove 133. Moreover, hydraulic pressure is supplied from the vertical hole 134 through the horizontal hole 135 in the interior of the camshaft to the retarding hydraulic pressure chamber 52. Furthermore, the hydraulic fluid that had been accumulated in advance in the exhaust-side advancing hydraulic line 120 flows backward through the exhaust-side advancing hydraulic line 120 under pressure from the retarding hydraulic pressure chamber 52.

As described above, when the accelerator pedal is released from the low-medium load state or high load state, the control is exerted such that the overlap of the intake/exhaust valves 12 and 13 is changed from large to small. In this case, as shown in FIGS. 12 and 13, the retarding annular groove 113 is positioned in the center of the cam cap 4 in the width direction, so the distance in the width direction from the retarding annular groove 113 to either edge of the bearing 184 becomes longer, and the hydraulic fluid supplied to the exhaust-side retarding hydraulic pressure chamber 52 is less likely to leak to the outside from the retarding annular groove 113. Similarly, the exhaust-side annular groove 123 is positioned in the center of the cam cap 4 in the width direction, so the distance in the width direction from the advancing annular groove 123 to either edge of the bearing 184 becomes longer, and the hydraulic fluid supplied to the exhaust-side advancing hydraulic pressure chamber 51 is less likely to leak to the outside from the advancing annular groove 123. Accordingly, in the case that the overlap is made smaller, the losses of intake-side retarding hydraulic pressure supplied by the intake hydraulic pressure control valve 23 and the losses of exhaust-side retarding hydraulic pressure supplied by the exhaust hydraulic pressure control valve 24 are reduced, so the responsiveness of this hydraulic pressure is increased, and the retarding control on the intake side and the advancing control on the exhaust side, namely control that makes the overlap smaller, is performed promptly and as a result, the stabilization of engine speeds and the suppression of the occurrence of engine stalls is achieved.

Moreover, in the present embodiment, as similarly further shown in FIGS. 12 and 13, by positioning the intake-side advancing annular groove 104 near the edge of the cam cap 4 in the width direction, the hydraulic fluid discharged from the exhaust-side advancing hydraulic pressure chamber 51 leaks more easily to the outside from the advancing annular groove 104. Similarly, by positioning the exhaust-side retarding annular groove 133 near the edge of the cam cap 4 in the width direction, the hydraulic fluid discharged from the exhaust-side retarding hydraulic pressure chamber 52 leaks more easily to the outside from the retarding annular groove 133. Accordingly, the rotor 35 is retarded promptly on the intake side and is advanced promptly on the exhaust side, so it is possible to reduce the response lag from when the retarding control or the advancing control is exerted until the actual retarding or advancing occurs, and thus when the overlap is reduced, even more prompt and better intake-side delay control and exhaust-side advance control is achieved.

In addition, by positioning the intake-side advancing annular groove 104 and the exhaust-side retarding annular groove 133 on the sides close to the variable phase mechanisms 21 and 22 shown in FIG. 1, the length of the advancing hydraulic line 100 from the intake-side advancing hydraulic pressure chamber 51 to the advancing annular groove 104 (in this embodiment, the length of the horizontal hydraulic line 108 within the intake camshaft 5 shown in FIG. 3) and the length of the retarding hydraulic line 130 from the exhaust-side retarding hydraulic pressure chamber 52 to the retarding annular groove. 133 (in this embodiment, the length of the horizontal hydraulic line 135 within the exhaust camshaft 6 shown in FIG. 5) are shortened. As a result, the line resistance to the hydraulic fluid discharged from the hydraulic pressure chambers 51 and 52 is reduced, so the intake-side advancing hydraulic pressure and the exhaust-side retarding hydraulic pressure are bled even more promptly and better, thus increasing the responsiveness of control that reduces the overlap. In addition, as a result of the line resistance to the hydraulic fluid being reduced and the bleeding of hydraulic fluid improving, the engine 1 will halt in an advanced state, thus improving the ignition and starting characteristics when the engine 1 is next started.

On the other hand, when the engine 1 is halted, the hydraulic pump (not shown) is also halted, so the hydraulic fluid that had flowed through the hydraulic lines will flow downward and the air will be entrained within the hydraulic lines. When the engine 1 is next started, the hydraulic control is exerted such that the exhaust camshaft 6 and the rotor 35 move to the most advanced position, but if air enters the variable exhaust phase mechanism 22 then various deleterious effects occur such as the stipulated hydraulic pressure not being attained. To solve this problem, as shown in FIG. 7, the countermeasures are taken so that the air that is compressed at the time that hydraulic fluid is supplied to the exhaust-side advancing hydraulic line 120 and advancing hydraulic pressure chamber 51 is bled outside (released into the atmosphere) before reaching the respective intake-side and the exhaust-side lock releasing hydraulic pressure chambers 46 which communicate with the exhaust-side advancing hydraulic line 120 (see FIGS. 3 and 5). Specifically, the exhaust hydraulic pressure control valve 24 is attached to the cam cap 4 with its axial line pointed in the vertical direction, or the exhaust-side advancing hydraulic line 120 is positioned above the retarding hydraulic line 130 so, as shown in FIG. 7 for example, the advancing output port 66 to the exhaust-side advancing hydraulic line 120 in the exhaust hydraulic pressure control valve 24 is positioned upward, so the distance a from the advancing output port 66 to the upper edge of the cam cap 4 becomes shorter.

As a result, at the time that the engine 1 is started, in the midst of air being sent from the main pressure supply line 140 via the input port 61 and output port 66 in the exhaust hydraulic pressure control valve 24 to the advancing hydraulic line 120, as shown on FIG. 7 for example, this air which is lighter than the hydraulic fluid is more easily bled from the gap β between the hollow valve case 68 of the exhaust hydraulic pressure control valve 24 and its valve insertion hole 24*a* in the cam cap 4, or from the gap between the hollow valve case 68 and spool 69 of the exhaust hydraulic pressure control valve 24, upward to the drain ports 64 and 65 or the like and to the outside. Moreover, the distance from the advancing hydraulic line 120 and the upper edge of the cam cap 4 within which this hydraulic line 120 is inserted becomes shorter, so the air again is more easily bled to the outside from the gap between the cam cap 4 and cover member 150 which cooperatively form this exhaust-side advancing hydraulic line 120. Because of the above, the problem of the compressed air pushing out the lock pin 43 before the advancing hydraulic pressure reaches the advancing hydraulic pressure chamber 51 can be readily averted.

In contrast, if the exhaust-side advancing hydraulic line 120 is conversely positioned below the retarding hydraulic line 130, then the advancing output port 66 to the advancing hydraulic line 120 in the exhaust hydraulic pressure control valve 24 is also positioned below, and as a result, even if the air leaks out from this output port 66 through the various leaks described above, the distance to the upper edge is long (namely, the distance moved until being released into the atmosphere is long) so there is a risk that air cannot be easily bled to the outside (namely, the air pressure is not easily reduced).

In addition, to describe the lock mechanism of the variable phase mechanisms 21 and 22, when the rotor 35 reaches the most retarded position on the intake side and the most advanced position on the exhaust side, the lock pin 43 which is normally pressed toward the sprocket 7 and 8 side by the return spring 45 is inserted into the indentations 44 provided on the sprockets 7 and 8, so that the rotor 35 and the sprockets 7 and 8 can no longer rotate relative to each other. Moreover, when advancing hydraulic pressure for exhaust is supplied to the releasing hydraulic pressure chamber 46, the lock pin 43 comes out and the rotor 35 is again able to operate freely. However, when the engine 1 is started, air may intrude into the exhaust-side advancing hydraulic pressure chamber 51 and the air pressure may cause the lock pin 43 to come out. If this happens, the rotation of the camshafts 5 and 6 become unstable at the time that the engine 1 is started, causing problems in which abnormal engine 1 sounds and the vibration occur. Here, by providing the exhaust-side advancing hydraulic line 120 at the upper position, the air pressure entering the advancing hydraulic pressure chamber 51 can be suppressed, so it is possible to prevent the lock pin 43 being knocked out by air pressure.

Figure 22:
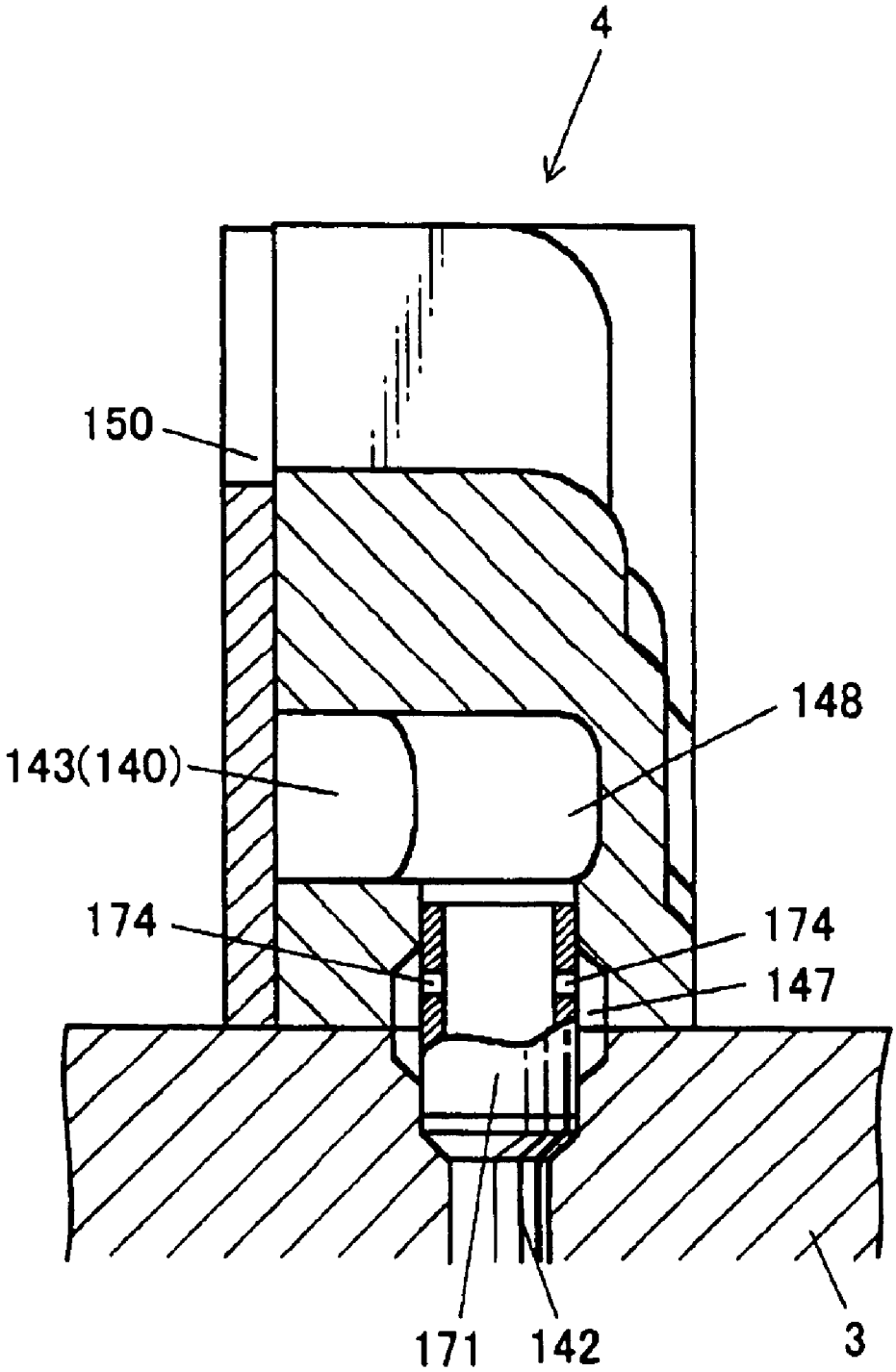
FIG. 22 shows a cross sectional view taken along a line L—L of FIG. 10.

The mechanism for positioning the cam cap 4 on the cylinder head 3 will now be described. As shown in FIG. 22, the positioning mechanism is provided with two pins, namely, a first tubular pin 171 that links the vertical connection line 147 of the main pressure supply line 140 to the vertical hole 142 formed in the cylinder head 3, and, as shown in FIG. 13, a second tubular pin 173 that links the cylinder head 3 to the cam cap 4 at the penetration hole 162 of the bolt farthest from the hydraulic pressure control valve 24 among the bolts 161 that fasten the cylinder head 3 to the cam cap 4 (the double lines on the inside of the bolt holes 162 of FIG. 13 illustrate the step areas contacted by the second tubular pin 173). The vertical hole 142 on the cylinder head 3 side leads to the hydraulic pressure source (not shown).

Here, as is clear from FIG. 22, a restrictor hole 174 is provided in the peripheral surface of the first tubular pin 171. In addition, as is clear from FIG. 13, lubricating fluid grooves 175 and 176 that reach the bearing surfaces 4*a* and 4*b* of the intake camshaft 5 and exhaust camshaft 6 respectively from this vertical hole 147 are provided. In this case, the bolts 161 disposed between the two camshafts 5 and 6 are positioned upon the lines for these lubricating fluid grooves 175 and 176 so in order to avoid these bolts 161, a groove 179 that curves around these bolt holes 162 is provided so that the hydraulic fluid can be supplied to the bearing surfaces 4*a* and 4*b* of the two camshafts 5 and 6 without obstruction.

The foregoing embodiment was described with regard to the case where the cam cap 4 is provided with the intake side and the exhaust side combined as a unit, but separate the cam caps 4 for the intake side and the exhaust side may also be provided. In addition, the positions at which the hydraulic pressure control valves 23 and 24 are disposed is not limited to the mode described above, but rather front the covers 15 may be provided for both the intake and exhaust hydraulic pressure control valves 23 and 24, and the cam caps 4 may be provided for both the intake and exhaust hydraulic pressure control valves 23 and 24. Moreover, both the intake and exhaust hydraulic pressure control valves 23 and 24 may be either directly or indirectly disposed upon the cylinder head 3.

Although the present invention has been explained with reference to specific, preferred embodiments, one of the ordinary skilled in the art will recognize that modifications and improvements can be made while remaining within the scope and spirit of the present invention. The scope of the present invention is determined solely by appended claims.

What is claimed is:

1. An engine variable valve timing system that varies an overlap period, during which intake and exhaust valves are both open, from large to small when an accelerator pedal is returned from a load state to an idling state, the system comprising:

a hydraulic variable intake phase mechanism and a hydraulic variable exhaust phase mechanism respectively provided on the ends of an intake camshaft and exhaust camshaft that respectively vary the respective phases of the camshafts to a crankshaft, the variable phase mechanisms respectively having advancing hydraulic pressure chambers and retarding hydraulic pressure chambers;

an intake hydraulic pressure control valve and an exhaust hydraulic pressure control valve that respectively control the hydraulic pressure of hydraulic fluid supplied to the advancing hydraulic pressure chambers and the retarding hydraulic pressure chambers of the variable phase mechanisms;

an intake-side advancing hydraulic line and an intake-side retarding hydraulic line that respectively connect the intake hydraulic pressure control valve to the advancing hydraulic pressure chamber and the retarding hydraulic pressure chamber of the variable intake phase mechanism; and an exhaust-side advancing hydraulic line and an exhaust-side retarding hydraulic line that respectively connect the exhaust hydraulic pressure control valve to the advancing hydraulic pressure chamber and the retarding hydraulic pressure chamber of the variable exhaust phase mechanism;

wherein portions of the intake-side advancing hydraulic line and the intake-side retarding hydraulic line respectively constitute annular grooves for advancing and retarding provided on the intake camshaft bearing surface of the cam cap which supports the intake camshaft, and portions of the exhaust-side advancing hydraulic line and the exhaust-side retarding hydraulic line respectively constitute annular grooves for advancing and retarding provided on the exhaust camshaft bearing surface of the cam cap which supports the exhaust camshaft;

wherein the annular groove for retarding on the intake camshaft bearing surface and the annular groove for advancing on the exhaust camshaft bearing surface are respectively provided in the center in the width direction of their respective bearing surfaces so that the hydraulic fluids in these annular grooves are respectively less susceptible from leaking out from these respective annular grooves;

wherein the annular groove for advancing on the intake camshaft bearing surface and the annular groove for retarding on the exhaust camshaft bearing surface of the cam cap are respectively provided near the edges of their respective bearing surfaces in the width direction so that the hydraulic fluids in these annular grooves are respectively more susceptible to leak out from these respective annular grooves;

whereby the phases of the camshafts are retarded promptly or the intake side and advanced promptly on the exhaust side so as to obtain a stable combustion when the accelerator pedal is returned from the load state to the idling state.

2. An engine variable valve timing system according to claim 1, wherein the annular groove for advancing on the intake side and the annular groove for retarding on the exhaust side are provided near the edges of their respective bearing surfaces in the width direction, on the side close to respective variable phase mechanisms.

3. An engine variable valve timing system according to claim 1, wherein the variable exhaust phase mechanism is provided with a spring at presses the camshaft in the advancing direction with respect to a crankshaft-side rotating ember.

4. An engine variable valve timing system according to claim 1, wherein the exhaust hydraulic pressure control valve is attached to the cam cap toward the vertical direction, and the portion of the exhaust-side advancing hydraulic line that extends from the exhaust hydraulic pressure control valve to the annular groove is provided in a position above the portion that extends from the exhaust hydraulic pressure control valve to the annular groove.

* * * * *

UNITED STATES PATENT AND TRADEMARK OFFICE

CERTIFICATE OF CORRECTION

PATENT NO. : 6,860,247 B2
DATED : March 1, 2005
INVENTOR(S) : Akira Asai et al.

It is certified that error appears in the above-identified patent and that said Letters Patent is hereby corrected as shown below:

Column 18,
Line 42, delete "or" and insert therefor -- on --.
Line 54, delete "at" and insert therefor -- that --.

Signed and Sealed this

Seventeenth Day of May, 2005

JON W. DUDAS
*Director of the United States Patent and Trademark Office*